US008302341B2

(12) United States Patent
Fonte

(10) Patent No.: US 8,302,341 B2
(45) Date of Patent: Nov. 6, 2012

(54) STRESS INDUCED CRYSTALLOGRAPHIC PHASE TRANSFORMATION AND TEXTURING IN TUBULAR PRODUCTS MADE OF COBALT AND COBALT ALLOYS

(75) Inventor: Matthew V. Fonte, Charlestown, MA (US)

(73) Assignee: Dynamic Flowform Corp., Billerica, MA (US)

( * ) Notice: Subject to any disclaimer, the term of this patent is extended or adjusted under 35 U.S.C. 154(b) by 179 days.

(21) Appl. No.: 12/787,778

(22) Filed: May 26, 2010

(65) Prior Publication Data

US 2011/0011253 A1 Jan. 20, 2011

Related U.S. Application Data

(60) Provisional application No. 61/181,042, filed on May 26, 2009, provisional application No. 61/302,778, filed on Feb. 9, 2010.

(51) Int. Cl.
*F41A 21/00* (2006.01)

(52) U.S. Cl. ..... 42/76.1; 89/14.7

(58) Field of Classification Search ..... 42/76.01, 42/76.1, 76.02; 89/14.7, 14.8, 14.05
See application file for complete search history.

(56) References Cited

U.S. PATENT DOCUMENTS 3,091,022 A 5/1963 Faulkner
4,359,352 A * 11/1982 Ray et al. ..... 75/246
5,470,373 A * 11/1995 Edelstein et al. ..... 75/255
6,068,814 A * 5/2000 Kang et al. ..... 420/438
6,615,702 B1 * 9/2003 Julien ..... 89/16
7,482,065 B2 * 1/2009 Branagan ..... 428/635
7,601,232 B2 * 10/2009 Fonte et al. ..... 148/670
7,963,202 B1 * 6/2011 Becker et al. ..... 89/14.05
2004/0236433 A1 * 11/2004 Kennedy et al. ..... 623/23.53
2005/0279630 A1 * 12/2005 Fonte ..... 204/298.21
2006/0070688 A1 * 4/2006 Fonte et al. ..... 148/670
2006/0288854 A1 * 12/2006 Witherell et al. ..... 89/14.05
2008/0066831 A1 * 3/2008 Srivastava ..... 148/317
2008/0202641 A1 * 8/2008 Hilty et al. ..... 148/518
2009/0217812 A1 * 9/2009 Whitaker et al. ..... 89/36.02
2010/0236122 A1 * 9/2010 Fonte ..... 42/76.1

OTHER PUBLICATIONS

Mani Krishna et al, "Microstructural and Textural Developments During Zircaloy-4 Fuel Tube Fabrication", Journal of Nuclear Materials, vol. 383, pp. 78-85, 2008.
Del Corso, "Effect of Cold Drawing & Heat Treating on Powder Metallurgy Processed ASTM F 1537 Alloy 1 & Alloy 2 Barstock", Carpenter Technology Corporation, Reading, PA, 6 pages, 2003.
Gloaguen et al., "Measurement and Prediction of Residual Stresses and Crystallographic Texture Development in Rolled Zircaloy-4 Plates: X-ray Diffraction and the Self-Consistent Model", Acta Materialia, vol. 55, pp. 4369-4379, 2007.

(Continued)

*Primary Examiner* — Benjamin P Lee
(74) *Attorney, Agent, or Firm* — Sunstein Kann Murphy & Timbers LLP

(57) ABSTRACT

A method of producing a cobalt-based tubular product includes forming a cobalt or cobalt alloy tubular workpiece having at least about 30% by weight of fcc phase and subjecting the workpiece to at least about a 20% wall reduction at a temperature below a recrystallization temperature of the workpiece using a metal forming process. The metal forming process may include radial forging, rotary swaging, pilgering and/or flowforming. A gun barrel includes a tubular component made of a cobalt-based superalloy material. The component has at least about 25% by weight of hcp phase with basal planes radially oriented perpendicular to an inner diameter of the component.

24 Claims, 13 Drawing Sheets

OTHER PUBLICATIONS

Aguayo et al., "Elastic Stability and Electronic Structure of fcc Ti, Zr, and Hf: A First-principles Study", Physical Review B, vol. 65, 092106, 4 pages, Feb. 2002.

Paul et al., "Hot Working Characteristics of Cobalt in the Temperature Range 600-950° C", Scripta Materialia, vol. 60, pp. 107-107, 2009.

Janaki Ram et al., "Microstructure and Wear Properties of LENS® Deposited medical Grade CoCrMo", J. Mater Sci: Mater Med, vol. 19, pp. 2105-2111, 2008.

Mani-Medrano et al., "Effect of Plastic Deformation on the Isothermal FCC/HCP Phase Transformation During Aging of Co-27Cr-5Mo-0.05C Alloy", Materials Science Forum, vol. 560, pp. 23-28, 2007.

Robertson et al., "Crystallographic Texture for Tube and Plate of the Superelastic/Shape-Memory Alloy Nitinol Used for Endovascular Stents", Wiley InterScience, pp. 190-199, 2004.

Robertson et al., "Effect of Product Form and Heat Treatment on the Crystallographic Texture of Austenitic Nitinol", J. Mater Sci, vol. 41, pp. 621-630, 2006.

Theaker et al., "Development of Crystallographic Texture in CANDU Calandria Tubes", Thirteenth International Symposium, ASTM STP, pp. 445-464, 2002.

Montero-Ocampo et al., "Effect of Fcc-Hcp Phase Transformation Produced by Isothermal Aging on the Corrosion Resistance of a Co-27CR-5Mo-0.05C Alloy", Metallurgical and Materials Transactions A, vol. 33A, pp. 2229-2235, Jul. 2002.

Opris et al., "Development of Stellite Alloy Composites with Sintering/HIPing Technique for Wear-Resistant Applications," Materials & Design, vol. 28, pp. 581-591, 2007.

Yu et al., "A Comparison of the Tribo-Mechanical Properties of a Wear Resistant Cobalt-Based Alloy Produced by Different Manufacturing Processes", Transactions of the ASME, vol. 129, pp. 586-594, Jul. 2007.

* cited by examiner

STRESS INDUCED CRYSTALLOGRAPHIC PHASE TRANSFORMATION AND TEXTURING IN TUBULAR PRODUCTS MADE OF COBALT AND COBALT ALLOYS

CROSS-REFERENCE TO RELATED APPLICATIONS

This patent application claims priority to U.S. Provisional Patent Application No. 61/181,042 filed May 26, 2009, entitled STRESS INDUCED CRYSTALLOGRAPHIC PHASE TRANSFORMATION AND TEXTURING IN TUBULAR PRODUCTS MADE OF COBALT AND COBALT ALLOYS, and claims priority to U.S. Provisional Patent Application No. 61/302,778 filed Feb. 9, 2010, entitled SYSTEM AND METHOD OF PRODUCING AUTOFRETTAGE IN TUBULAR COMPONENTS USING A FLOW-FORMING PROCESS, the disclosures of which are incorporated by reference herein in their entirety.

TECHNICAL FIELD

The invention generally relates to tubular components and, more particularly, the invention relates to tubular products made of cobalt and cobalt alloys.

BACKGROUND ART

Gun barrels have been made in substantially the same way since the early 1900's, with only minor improvements in processes and materials since then. Conventional steel alloys used in gun barrels, including rifles, side arms, and shotguns as well as barrels for large naval and ground artillery and high rate-of-fire weapons, such as machine guns and cannons, are heat treatable to increase their strength. However, the trade-off for attaining high strength by heat treatment in steel alloys is an increase in brittleness. Put another way, the ability of the steel alloy to yield without rupturing when its yield strength is exceeded, a property known as toughness, is reduced when the steel is heat treated to achieve high strength. A high strength brittle material in a gun barrel is dangerous because overpressure caused by a plugged barrel or excessive powder loads, or weakness in the barrel caused by damage, fatigue, corrosion, or other such factors could cause the barrel to burst catastrophically instead of just bulge. Since the bursting usually occurs at the breech end, near the shooter's face, the potential for serious injury, blinding, or death is more likely with brittle materials. Accordingly, it is the normal practice, although not universal, for gun manufacturers to sacrifice potential strength and hardness for toughness of their barrel materials by not heat treating to its maximum strength, usually less than 32 KSI for a typical high strength barrel material. As a result, the barrel wall thickness must be made commensurably thicker and the "soft" condition of the barrel material is susceptible to rapid erosion on the inside diameter of the barrel from the passage of the projectiles.

Corrosion resistance of high carbon steels is notoriously poor. Special coatings and other techniques are available to protect the gun barrels from corrosive influences such as salt water, most acids, products of propellant combustion, and many other substances common in the environment. However, such coatings are most useful if applied frequently, especially immediately after each use of the gun, but it is rarely convenient to do so. Consequently, there is a period following use of the gun before it is cleaned and coated with the protective coating during which rapid corrosion can occur, especially since the combustion products of the propellant, and the projectile fragments remaining in the barrel can create galvanic corrosion. The resultant pitting of the bore then tends to trap additional corrosive materials, further exacerbating the corrosive effects. Thus, there is a need to find barrel materials that can improve and resist the effects of these corrosive substances.

Hot plastic deformation of a conventional steel barrel is a serious problem, especially in weapon systems. At elevated temperatures, the steel barrel is effectively hot forged slightly each time the gun is fired, increasing the internal diameter of the bore slightly and, over time, increasing it enough that the bore, even without erosion, is no longer within bore tolerance. In this case, the projectile is loose in such an over-sized bore and results in poor accuracy for the gun. Moreover, the blow-by of propellant gases around the projectile in the bore is so great that the projectile does not develop the velocity it needs to attain its specified range, and instead falls short of its intended target. Thus, there is a need for a barrel material that has increased biaxial strength at elevated temperatures to eliminate the deformation of the barrel and its undesirable blow-by or blow-back effect.

A goal in designing modern military weapons is to attain higher muzzle velocity for the projectile to attain longer range, flatter trajectory, higher impact energies and greater accuracy. One conventional technique for increasing the muzzle velocity is to increase the propellant energy. The limitations of this technique are the burst strength of the barrel, primarily in the breech area when the barrel is hot. This region of the barrel is where the largest pressure spike occurs while the projectile is fired and where the primary propellant/barrel reaction occurs.

Today, guns require relatively thick-walled barrels to contain the high propellant gas pressure and provide a large heat sink to prolong the period during which high rate-of-fire can be tolerated before the accuracy deteriorates to the point beyond which further expenditure of ammunition is useless. Such conventional thick walled steel gun barrels are very heavy and have a tendency to droop at the muzzle end when aimed at low elevations. In addition, the barrel becomes hot from aggressive firing and the Young's modulus of the steel drops. This has been an intractable problem in the past because of the need for high burst strength and the high density of the only known materials that were proven for use in gun barrels. Thus, a stronger, more corrosion and wear resistant metal gun barrel that is comparatively light weight, has a high Young's modulus for stiffness, and high burst strength is needed. A gun barrel made of tough, high strength materials may be made thinner than the current barrels to reduce the weight of the barrel. In addition, the high strength and toughness of the barrel material would permit use of higher energy propellant loads for increased muzzle velocity, range and accuracy. Finally, such an ideal gun barrel would have improved wear, erosion and corrosion resistance, a low coefficient of friction with the projectile materials, a high heat capacity, and low coefficient of thermal expansion to minimize the distorting effects.

Cobalt-based superalloys are well known and widely used as liners in many steel machine gun barrels which are press-fit into the breech section of the steel barrel. The liners extend the life of the barrel by enhancing their strength, wear and corrosion resistance. For example, Stellite 21 has been in use for over half a century as a liner material for the M2 50 caliber machine gun. Typically, these liners are made to Military Specification "Cobalt-Chromium Alloy Castings" (for barrel tube liners) per Mil-C-13358E(MR) dated Jan. 4, 1984. This military specification calls for the liner to be made from a cast, cobalt alloy, such as commercial alloy Stellite 21. There are similar commercial alloys which are not cast, but rather made from a powder metal such as CCM Plus, e.g., see Table 1 below.

TABLE 1

Chemistries of military specification for cobalt gun barrel liners, compared to Stelltie 21 and CCM Plus.

| | Carbon | Cobalt | Chromium | Molybdenum | Nickel | Fe |
|---|---|---|---|---|---|---|
| Barrel Tube Liners (Mil-C-13358F(MR) | 0.20 | ~60 | 25.5-29.5 | 4.5-6.5 | 1.75-3.25 | 2.5 (max.) |
| Stellite 21 | 0.20-0.35 | ~64 | 26.0-29.0 | 4.5-6.0 | 2.0-3.0 | 3.0 (max.) |
| CCM Plus | 0.20-0.30 | ~65 | 26.0-30.0 | 5.0-7.0 | | |

The U.S. Army is currently pursuing efforts to reduce gun barrel wear and erosion. In addition to resisting chemical attack, cobalt alloys have additional characteristics that make it attractive as a gun barrel liner. First, it is relatively inexpensive as compared to tantalum and its alloys, which are also being tested as liners. Second, cobalt alloys have sufficient shear strength high enough to resist the reaction forces of the projectile on the lands of the rifled M242 barrel. It was estimated that pure tantalum would not have a high enough strength to be used in the M242 barrel. Finally, it is expected that cobalt-based materials, such as Stellite materials, can be machined to form the lands and grooves of a rifled barrel. In contrast, difficulties have been experienced in machining an explosively-clad tantalum alloy in an M242 Bushmaster barrel. Despite the high temperature strength and wear resistant benefits that cobalt alloys have over other superalloys, cobalt liners continue to wear out from firing under hot conditions and need to be replaced over time. FIG. 1 shows a machine gun barrel that has been cut in half to show the damaged inner surface of a cobalt liner. The cobalt liners eventually fail due to fatigue from the combination of repetitive firing pulses, extreme heat and pressure and also fail due to wear from the abrasiveness of the existing projectiles. Thus, there is a need to improve the cobalt liner used in conventional barrel materials.

SUMMARY OF EMBODIMENTS

In accordance with one embodiment of the invention, a method of producing a cobalt-based tubular product includes forming a cobalt or cobalt alloy tubular workpiece having at least about 30% by weight of fcc phase, and subjecting the workpiece to at least about a 20% wall reduction at a temperature below a recrystallization temperature of the workpiece using a metal forming process. The metal forming process may include radial forging, rotary swaging, pilgering and/or flowforming.

In accordance with related embodiments, the temperature of the metal forming process may be around room temperature. The method may further include annealing the workpiece after subjecting the workpiece to the wall reduction. The method may further include forming a rifling on an inner diameter of the workpiece. When the metal forming process is flowforming, the flowforming may include at least two flowforming passes and the workpiece may be annealed between the flowforming passes. The workpiece may be at least 50% or at least 80% by weight fcc phase. The wall reduction may be at least about 30% or at least about 50%. The tubular workpiece may be produced by rotary forging or rotary swaging. Embodiments may include a tubular component produced according to the method.

In accordance with another embodiment of the invention, a method of producing a cobalt-based superalloy tubular component includes forming a tubular workpiece made of a cobalt-based superalloy material having at least about 30% by weight of fcc phase. The tubular workpiece has an inner diameter and an outer diameter. The method further includes placing the workpiece on a mandrel such that the inner diameter is adjacent to the mandrel, and subjecting the workpiece to at least about a 20% wall reduction at a temperature below a recrystallization temperature of the workpiece using a metal forming process that compresses the outer diameter of the workpiece using a combination of axial and radial forces so that the mandrel contacts the inner diameter.

In accordance with related embodiments, the metal forming process may include radial forging, rotary swaging, pilgering and/or flowforming. The temperature of the metal forming process may be around room temperature. The method may further include annealing the workpiece after subjecting the workpiece to the wall reduction. The mandrel may further impart a rifling to the inner diameter of the workpiece. When the metal forming process is flowforming, the flowforming may include at least two flowforming passes. The tubular workpiece may be produced by rotary forging or rotary swaging. Embodiments may include a tubular component produced according to the method.

In accordance with another embodiment of the invention, a gun barrel includes a tubular component made of a cobalt-based superalloy material. The component has at least about 25% by weight of hcp phase with basal planes radially oriented perpendicular to an inner diameter of the component. In related embodiments, an area near the inner diameter may have compressive stresses. A surface of the inner diameter may have rifling. The tubular component may be a liner adjacent to an inner diameter of the gun barrel.

BRIEF DESCRIPTION OF THE DRAWINGS

The foregoing features of the invention will be more readily understood by reference to the following detailed description, taken with reference to the accompanying drawings, in which.

DESCRIPTION OF ILLUSTRATIVE EMBODIMENTS

Figure 1:
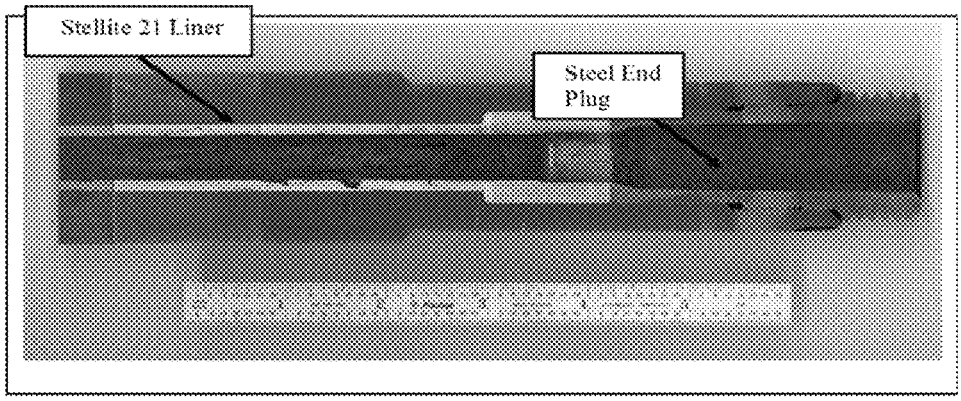
FIG. 1 shows a cross-sectional view of the inner diameter of a prior art machine gun barrel with a damaged cobalt liner.

Embodiments of the present invention provide a cobalt-based material and method of making same that has an improved wear resistance and biaxial strength. In addition, embodiments provide compressive hoop stresses on the inner diameter of the tubular component that should arrest any crack that may initiate on that surface, effectively improving the fatigue life of the component. The method forms a cobalt or cobalt-based alloy workpiece having at least about 30% by weight of fcc phase, preferably at least 50% by weight of fcc phase, and more preferably at least 80% by weight fcc phase. The method then subjects the workpiece to at least about a 20% wall reduction, preferably greater than 30% wall reduction, and more preferably greater than 50% wall reduction, at a temperature below a recrystallization temperature of the workpiece using a metal forming process. The metal forming process may include radial forging, rotary swaging, pilgering and/or flowforming. The wall reduction may be obtained by subjecting the workpiece to one or more flowforming passes. In addition, the workpiece may be subjected to one or more heat treatments to anneal the material before or after the one or more flowforming passes.

Providing compressive hoop stresses on the inner diameter and increasing the biaxial strength and wear resistance of a cobalt (Co) or cobalt-based alloy makes the material ideal for use as a gun barrel or gun barrel liner, extending the operating life of small arms weapon systems. Embodiments take advantage of cobalt's unique ability to allow for stress induced phase transformation from a face-centered cubic (fcc) crystallographic structure to its hexagonal close packed (hcp) structure. The resultant phase transformation and texturing effect from the cold work experienced during the metal forming process (e.g., mechanical twinning as a deformation mode in addition to crystallographic slip) radially orients the hcp's basal planes perpendicular to the center line of the inner diameter of the barrel. This strong texturing of the hexagonal crystals increases the stacking fault energy, effectively making a tightly locked crystallographic lattice shield on the barrel's bore and increasing the biaxial strength both in the longitudinal and transverse orientations. The crystal basal planes of a cobalt-based flowformed product are uniquely aligned parallel with one another, creating a smooth, hard face structure and improving its wear resistance due to less varied topography on the barrel's bore to be worn down during firing. In addition, the six facet hcp crystals are packed tightly together in a similar orientation due to a texturing effect, improving the transverse and longitudinal strength. The compressive hoop stresses and the refined microstructure from the heavily cold-worked material also helps to improve barrel fatigue life. These small grains have small grain boundaries, minimizing the space for a crack to initiate and propagate from. These same smaller grain boundaries help to prevent intergranular corrosion. These are all desirable conditions for improving the life of a gun barrel. Details of illustrative embodiments are discussed below.

Superalloys are a class of metals that retain their strength and corrosion resistance at temperatures above 1,200° F. The superalloy materials may include nickel-based superalloys, cobalt-based superalloys, iron-based superalloys, or a combination thereof. Tubular components may be formed by a number of different manufacturing processes, such as cast, powder metallurgy or wrought (e.g., forging, extrusion, rolling, etc.) processes. In general, the fabrication processes, along with the component's chemical composition, determine the component's microstructure (e.g., grain size, orientation, uniformity, shape). The crystallographic "texture" of a material is the distribution of crystallographic orientations in a polycrystalline material. Techniques such as x-ray diffraction and/or electron beam backscatter diffraction are required to analyze the crystallographic texture. A component in which these orientations are fully random is said to have no texture. If the crystallographic orientations are not random, but have some preferred orientation, then the component may have a weak, moderate or strong texture. The degree is dependent on the percentage of crystals having the preferred orientation. Texture may strongly influence material properties.

The cobalt-based superalloys are well known and widely used in industry primarily for wear applications involving unlubricated systems at elevated temperatures. These alloys contain generally around 30% Cr (chromium) to ensure a good corrosion resistance, between 4-17% W (tungsten) for solid solution strengthening and between 0.1-3% C (carbon) in order to form hard carbides. The high temperature crystal structure of pure cobalt (Co) in its stable phase is face-centered cubic (fcc). Below 800° F., the crystal structure of the stable phase is hexagonal close packed (hcp). Both Cr and W tend to increase the transformation temperature. Many of the strength properties of the cobalt superalloys arise from (1) the crystallographic texture of cobalt, (2) the solid-solution-strengthening effects of Cr, W, Mo (molybdenum), (3) the formation of metal carbides and (4) the corrosion resistance imparted by chromium. The cobalt superalloy material has a high corrosion resistance mainly due to the high chromium content that forms a thin passive chromium oxide layer with good adhesion, protecting the underlying matrix material.

Figure 2:
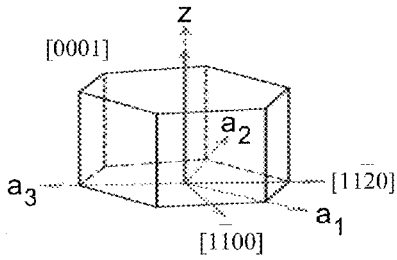
FIG. 2 shows an hcp crystal structure with basal planes and prism planes.

The method in which the material is processed, (e.g., cast, sintered, sintered and hot isostatic pressed (HIP), rolled, drawn, extruded, forged, flowformed, etc.) and any heat treatment steps contribute to modify the microstructure, transformation temperatures and mechanical properties of the material. These melting and manufacturing processing steps may lead to texturing (crystallographic alignment) of the material. More so than other materials, hcp materials that undergo temperature or stress induced phase transformations, such as cobalt or cobalt-based alloys, are significantly affected by its texturing during fabrication processes and subsequent heat treatment operations. Examples of metals having an hcp crystal structure are well known to those skilled in the art and include metals such as cobalt, titanium, zirconium, zinc, and alloys thereof. As shown in FIG. 2, the hcp crystal has a "basal plane" or c-plane, which is the plane perpendicular to the long axis (or z direction), or the flat, top plane and the plane opposite to it on the bottom of the crystal (the {0001} crystal plane family). The prism planes, or m-planes, are the six planes that make up the sides of the hexagonal structure (the {1-100} crystal plane family).

Deformation promotes a martensitic transformation in which thin platelets of the hcp phase form on the {111} planes of the fcc matrix. These platelets hinder the motion of dislocations and lead to significant strengthening. Post deformation aging in some Co alloys causes the precipitation of gamma prime, which is the ordered fcc phase responsible for the high strength of the multiphase family of cobalt-based and many nickel-based superalloys. Because these hcp alloys derive their unique non-linear and anisotropic mechanical behavior from stress-induced martensitic transformations, where the resulting stress levels are affected by crystallographic orientation, texture has a marked influence on its mechanical and wear resistant properties.

This fcc to hcp crystallographic transformation occurs in Co alloys and the ferrous-manganese (Fe—Mn) family of alloys. However, the fcc crystal structure does not appear on the usual pressure-temperature phase diagrams of other hcp alloys, such as titanium, zirconium and hafnium, making this phenomenon unique to cobalt. Co alloys in the form of a solid rod/bar, however, undergo deformation on the outer diameter of the component, and thus the center of the bar may be only mildly cold worked or may undergo no appreciable cold work at all. For example, a cobalt-based alloy with 28% chromium and 6% molybdenum and having a 0.335" diameter rod, was cold drawn up to 30% in a single reduction operation. In this example, the microstructure underwent a 38% fcc to hcp phase transformation. The percent of cold-work reduction appears to increase the percent of fcc to hcp phase transformation relatively linearly, such as shown in Table 2.

TABLE 2

Weight percent of hcp phase resulting from different cold reduction conditions

| Condition | Wt % HCP | Hardness HRC Core | Hardness HRC Surface |
|---|---|---|---|
| Unannealed 0.335" rd | 11% | 50 | 51.6 |
| Annealed (A) | 8% | 38.4 | 39.7 |
| A + 10% R | 21% | 49.3 | 43.2 |
| A + 20% R | 32% | 53 | 45.2 |
| A + 25% R | 30% | 54.5 | 45.8 |
| A + 30% R | 38% | 55.7 | 45.6 |
| A + 10% R + A + 10% R | 18% | 48.1 | 40.6 |
| A + 20% R + A + 20% R | 21% | 52.1 | 43.5 |
| A + 25% R + A + 25% R | 27% | 53.4 | 42.8 |

Notes:
A = Annealed @ 2050° F./100 min + WQ
R = Reduction of Area (Drawing Reduction)

Because the cold-drawing process on a solid bar can only perform about a 30% reduction before needing an anneal operation, the reduced bar has only a 38% hcp structure in its microstructure and the texturing effect is not significant, the hcp crystals are not tightly locked together in the microstructure mixture (38% hcp and 62% fcc), and the basal planes are not radially oriented.

Figure 3:
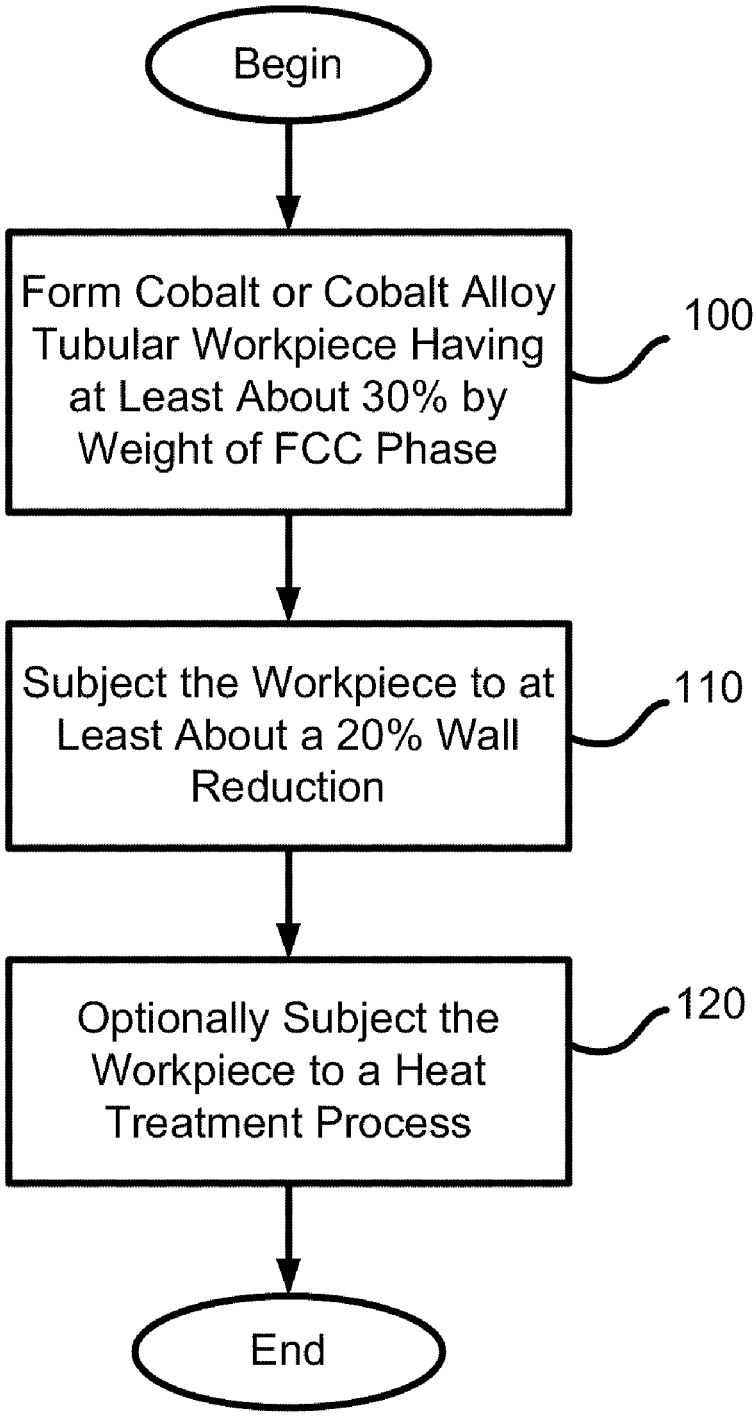
FIG. 3 shows a process of producing a tubular component according to embodiments of the present invention.

FIG. 3 shows a process of producing a tubular component according to embodiments of the present invention. The process begins at step 100, in which a tubular workpiece having at least about 30% by weight of fcc phase is formed. The tubular workpiece may be formed by any known process, e.g., rotary forged, rotary swaged, a drilled bar, etc., and is made of a cobalt or cobalt alloy, preferably a cobalt superalloy material. The tubular workpiece may be monolithic or may include a liner material bonded to the inner diameter of the workpiece. Alternatively, the tubular workpiece may be used as a liner material on the inner diameter of another tubular component. As known by those skilled in the art, the tubular workpiece may be formed having at least about 30% of fcc phase by adding a sufficient amount of certain alloying elements to suppress the fcc to hcp phase transformation to at or below room temperature. Alternatively, the tubular workpiece may be formed having at least about 30% of fcc phase by heating the component to a sufficient temperature in order to obtain the desired amount of fcc phase and then rapidly cooling (e.g., quenching in water, oil, etc.) the component so that the desired amount of fcc phase is maintained in the component.

In step 110, the workpiece is subjected to at least about a 20% wall reduction at a temperature below a recrystallization temperature of the workpiece using a metal forming process. The metal forming process may include radial forging, rotary swaging, pilgering and/or flowforming. Although the remaining discussion will be in the context of using flowforming as the metal forming process, discussion of flowforming is illustrative and not intended to limit the scope of various embodiments.

Flowforming is often a net shape, cold-working metal forming process used to produce precise, thin wall, cylindrical components. The components are usually made from metal or a metal alloy. Flowforming is typically performed by compressing the outer diameter of a cylindrical workpiece over an inner, rotating mandrel using a combination of axial, radial and tangential forces from two or more rollers. The material is compressed above its yield strength, causing plastic deformation of the material. As a result, the outer diameter and the wall thickness of the workpiece are decreased, while its length is increased, until the desired geometry of the component is achieved. Flowforming is typically a cold-forming process. Although adiabatic heat is generated from the plastic deformation, the workpiece, mandrel and rollers are typically flooded with a refrigerated coolant to dissipate the heat. This ensures that the material is worked well below its recrystallization temperature. Being a cold-forming process, flowforming increases the material's strength and hardness, textures the material, and often achieves mechanical properties and dimensional accuracies that are far closer to requirements than any warm or hot forming manufacturing process known to the inventor.

Two examples of flowforming methods are forward flowforming and reverse flowforming. Generally, forward flowforming is useful for forming, tubes or components having at least one closed or semi-closed end (e.g., a closed cylinder). Reverse flowforming is generally useful for forming tubes or components that have two open ends (e.g., a cylinder having two open ends). In some cases, a combination of forward and reverse flowforming may be utilized to successfully achieve the desired geometry. Typically, forward flowforming and reverse flowforming may be performed on the same flowforming machine by changing the necessary tooling.

Figure 4:
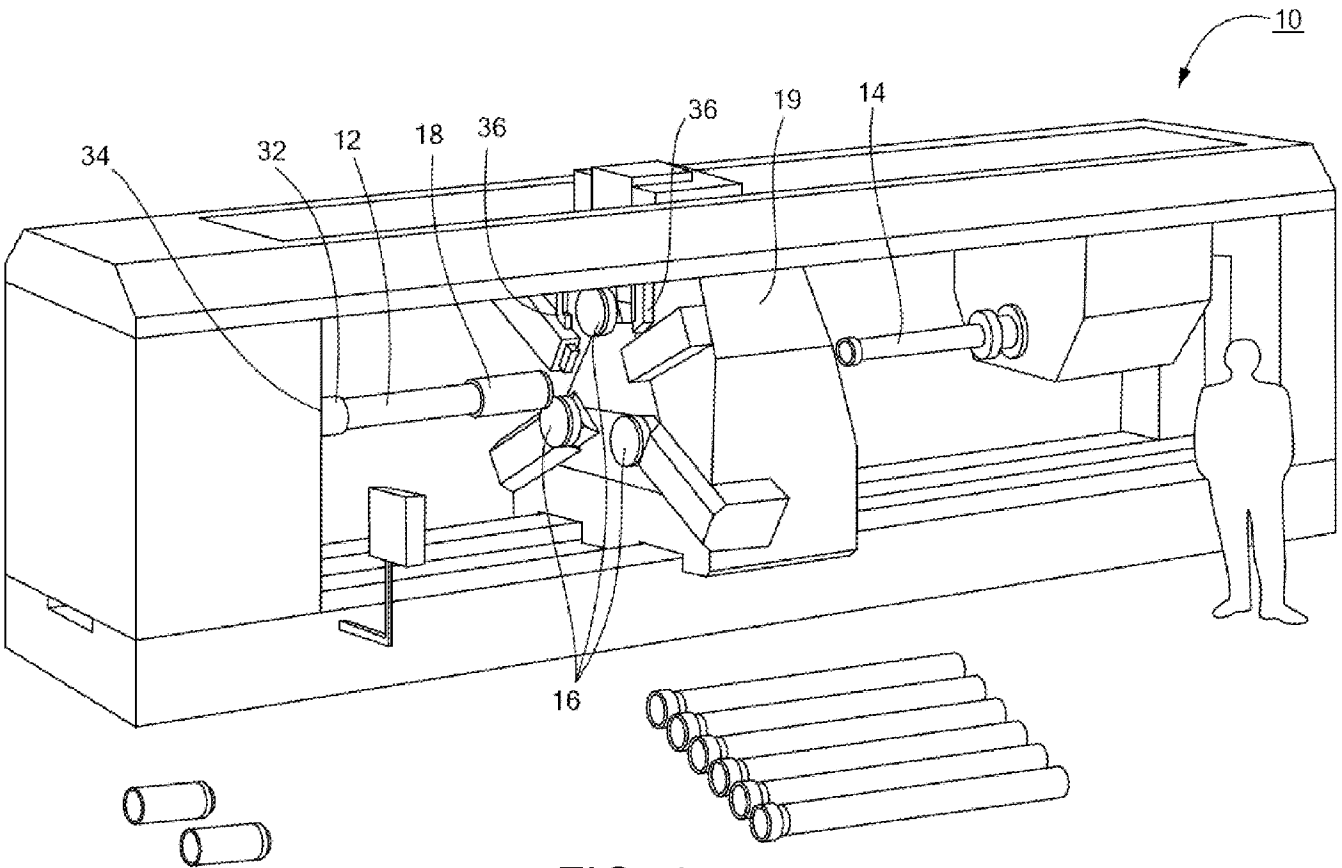
FIG. 4 shows an illustrative flowforming device according to embodiments of the present invention.

FIG. 4 schematically shows an illustrative flowforming device 10 according to some embodiments of the present invention. In this case, the flowforming device 10 is configured for forward flowforming. The flowforming device 10 includes a mandrel 12 for holding a cylindrical workpiece 18, a tailstock 14 that secures the workpiece 18 to the mandrel 12, two or more rollers 16 for applying force to the outer surface of the workpiece 18, and a movable carriage 19 coupled to the rollers 16. As shown in FIG. 4, the rollers 16 may be angularly equidistant from each other relative to the center axis of the workpiece 18. The rollers 16 may be hydraulically-driven and CNC-controlled.

Figure 5:
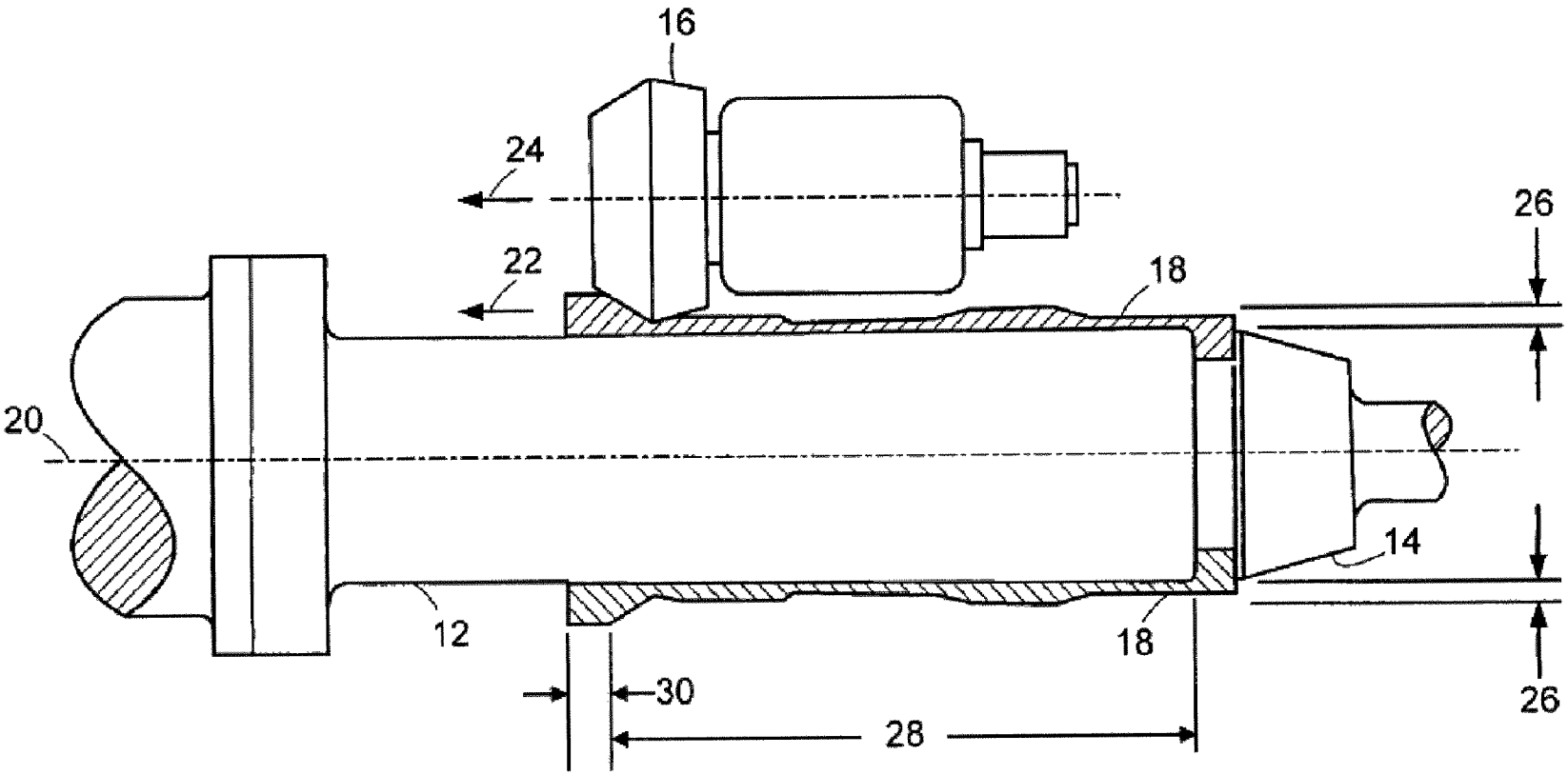
FIG. 5 shows a side-view of a workpiece undergoing a forward flowforming process according to embodiments of the present invention.

FIG. 5 shows a side-view of a workpiece 18 undergoing a forward flowforming process. During this process, the workpiece 18 is placed onto the mandrel 12 such that the inner diameter of the workpiece is adjacent to the mandrel 12 with its closed or semi-closed end toward the end of the mandrel 12 (to the right side of the mandrel, as shown in FIG. 4). The workpiece 18 may be secured against the end of the mandrel 18 by the tailstock 14, e.g., by means of a hydraulic force from the tailstock 14. The mandrel 12 and workpiece 18 may then rotate about an axis 20 while rollers 16 are moved into a position of contact with the outer surface of the workpiece 18 at a desired location along its length. The headstock 34 rotates or drives the mandrel 12 and the tailstock 14 provides additional help to rotate the mandrel 12, so that the long mandrel 12 spins properly.

The carriage 19 may then move the rollers 16 along the workpiece 18 (traveling from right to left, as shown in FIG. 4), generally in direction 24. The rollers 16 may apply one or more forces to the outside surface of the workpiece 18 to reduce its wall thickness 26 and its outer diameter, e.g., using a combination of controlled radial, axial and tangential forces. One or two jets 36 may be used to spray coolant on the rollers 16, workpiece 18 and mandrel 12, although more jets may be used to dissipate the adiabatic heat generated when the workpiece 18 undergoes large amounts of plastic deformation. The mandrel 12 may even be submersed in coolant (not shown), e.g., in a trough type device, so that the coolant collects and pools on the mandrel 12 to keep the workpiece 18 cool.

Rollers 16 may compress the outer surface of the workpiece 18 with enough force that the material is plastically deformed and moves or flows in direction 22, generally parallel to axis 20. Rollers 16 may be positioned at any desired distance from the outer diameter of mandrel 12 or the inner wall of workpiece 18, to produce a wall thickness 26 that may be constant along the length of the workpiece 18 or varied, as shown in FIG. 5. Length 28 represents the portion of the workpiece 18 that has undergone the flowforming process, whereas length 30 is the portion that has yet to be deformed. This process is termed "forward flowforming" because the deformed material flows in the same direction 22 as the direction 24 that the rollers are moving.

Figure 6:
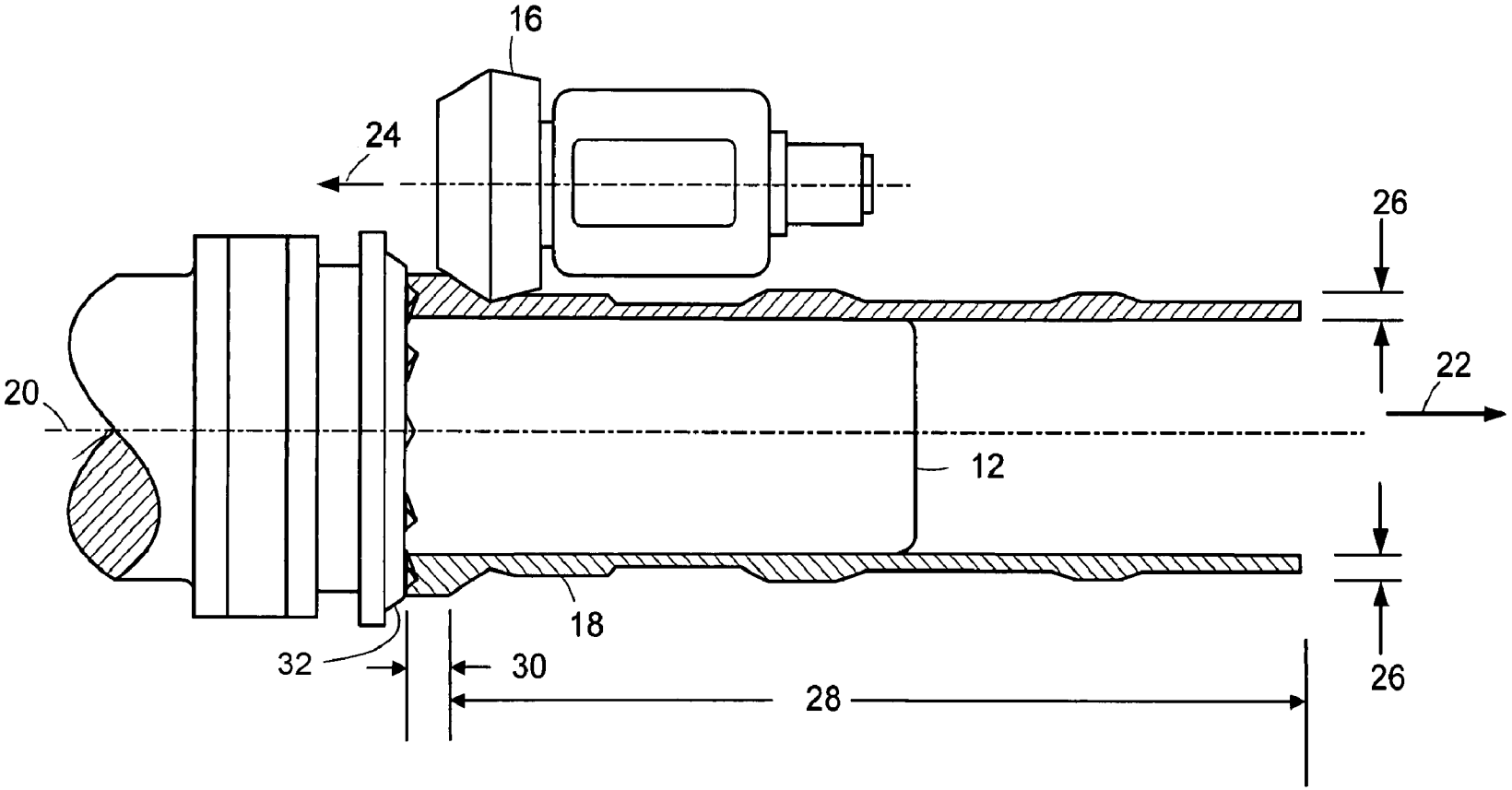
FIG. 6 shows a side-view of a workpiece undergoing a reverse flowforming process according to embodiments of the present invention.

In reverse flowforming, a flowforming device may be configured in a similar manner to that shown in FIG. 4, but a drive ring 32, rather than the tailstock 14, secures the workpiece 18 to the mandrel 12. As shown in FIG. 4, the drive ring 32 is located near the headstock 34 at the other end of the mandrel 12. FIG. 6 shows a side-view of a workpiece undergoing a reverse flowforming process. During this process, the workpiece 18 may be placed on the mandrel 12 and pushed all the way against the drive ring 32 at one end of the mandrel 12 (to the left side, as shown in FIG. 4). Rollers 16 may be moved into a position of contact with the outer surface of the workpiece 18 at a desired location along its length. The carriage 19 may then move towards the drive ring 32 (in a right to left direction, as shown in FIG. 4) applying a force to the workpiece 18. The force may push the workpiece 18 into the drive ring 32 where it may be entrapped or secured by a series of serrations or other securing means on the face of the drive ring 32. This allows the mandrel 12 and the workpiece 18 to rotate about an axis 20 while rollers 16 may apply one or more forces to the outer surface of the workpiece 18. The material is plastically deformed and moves or flows in direction 23, generally parallel to axis 20. Similar to forward flowforming, rollers 16 may be positioned at any desired distance from the outer diameter of mandrel 12 or the inner wall of workpiece 18, to produce a wall thickness 26 that may be constant or varied along the length of the workpiece 18. Length 28 represents the portion of the workpiece 18 that has undergone the flowforming process whereas length 30 is the portion that has yet to be deformed. As the workpiece 18 is processed, it extends down the length of the mandrel 12 away from drive ring 32. This process is termed "reverse flowforming" because the deformed material flows in the direction 22 opposite to the direction 24 that the rollers are moving.

In embodiments of the present invention, the workpiece 18 is subjected to one or more flowforming passes wherein the rollers 16 apply a force to the outer surface of the workpiece 18 at a temperature below the recrystallization temperature of the workpiece. Each flowforming pass compresses the walls of the workpiece 18, or some portion thereof, into a desired shape or thickness. The flowforming process cold works the material which usually reduces the grain size of the material and realigns the microstructure, relatively uniformly, in the longitudinal or axial direction parallel to the center line of the flowformed tube. When a material is cold worked, microscopic defects are nucleated throughout the deformed area. As defects accumulate through deformation, it becomes increasingly more difficult for slip, or the movement of defects, to occur. Thus, with the degree of cold work, the hardness and tensile strength of a material are increased while ductility and impact values are lowered. Therefore, if a material is subjected to too much cold work, the hardened, less ductile material may fracture. When the material is plastically deformed and trapped/compressed onto the hard mandrel under the set of rotating rollers, large wall reductions may be realized at one time, much more so than other cold-working processes such as rolling plate or drawing tubes on a bench. In addition, low temperature deformation (i.e., cold work) can induce the phase transformation from the fcc to the hcp structure depending on the stacking fault energy of the matrix and the transformation temperature. This compressive, axial and radial force deformation mechanism enables the Co-based alloys to undergo large percentages of phase transformation at one time and create strong texturing while being processed.

As known by those skilled in the art, cobalt and cobalt-based alloys are difficult to cold work due to a work-hardening of the metal which decreases the ductility and prohibits further cold forming until a stress-relieving heat treatment is applied to the metal parts. Once plastic deformation begins, an allotropic transformation in crystal structure from the cubic form to the hexagonal form takes place. This causes a stress-based phase transformation and the resultant hcp crystal structure retards further deformation and builds up with internal stresses. Consequently, the material cracks during most cold-working processes before too large of reductions or deformations can be achieved. The stresses built up by cold working of cobalt can be relieved only by an annealing heat treatment. Therefore, the production of cold-worked, cobalt products can be an expensive process, involving many small increments in reduction by rolling or drawing with intermediate annealing heat treatments necessary between each pass to eliminate the work-hardened condition and to soften the alloy for the next working operation.

In contrast, embodiments of the present invention discovered that cold working of these cobalt alloys over an inner mandrel into tubular products with large wall reductions (e.g., greater than 20%) allows the stressed induced phase transformation to happen with the majority of the crystal transformed into the hcp structure. Thus, a cobalt alloy workpiece having at least 30% fcc crystal structure permits cold forming this crystal structure at room temperatures. In addition, this allows the tubular products to have a preferred (very strong) crystallographic texturing effect which may be strategically exploited to increase the tube's biaxial strength and its wear resistance. This phenomenon is especially seen on the inner diameter of the tube where the material is being squeezed/compressed (cold worked) against the inner mandrel that its formed over. When large wall reductions are taken on cobalt alloy tubular products that have thin cross-sectional wall thicknesses, the texturing effect is magnified as compared to the texturing seen in solid bar that has a center core that experiences little reduction during processing. The flowforming manufacturing process is one kind of deformation process that allows large wall reductions to be accomplished on a thin-walled tube, causing a high degree of transformation. For example, cross-sectional wall reductions for most materials may be up to 75-80% of the starting wall thickness. Typically, the workpiece 18 may be flowformed up to four to six times its starting length without the need for an intermediate heat treatment process.

In addition to an increase in the biaxial strength and wear resistance, embodiments may also provide compressive residual stresses at the inner diameter of the component induced by an autofrettage process. Autofrettage is a metal fabrication technique used on tubular components to provide increased strength and fatigue life to the tube by creating a compressive residual stress at the bore. During a typical autofrettage process, a pressure is applied within a component resulting in the material at the inner surface undergoing plastic deformation while the material at the outer surface undergoes elastic deformation. The result is that after the pressure is removed, there is a distribution of residual stress, providing a residual compressive stress on the inner surface of the component. In embodiments of the present invention in the final flowforming pass, the rollers 16 may be configured in such a way that the rollers compress the outer diameter of the workpiece using a combination of axial and radial forces so as to cause the inner diameter of the workpiece 18 to be compressed onto the mandrel 12 with sufficient force so that the inner diameter plastically deforms sufficiently enough, imparting a compressive stress to the inner diameter. This may be accomplished by pulling the rollers sufficiently apart from one another. The flowform process then causes the workpiece 18 to compress against and grip the mandrel 12 compared to the workpiece 18 just releasing from or springing back off of the mandrel 12 which is what typically occurs during a standard flowforming process. Causing the inner diameter to compress against the mandrel 12 in this way imparts a compressive hoop stress on the inner diameter of the flowformed component.

Figure 7:
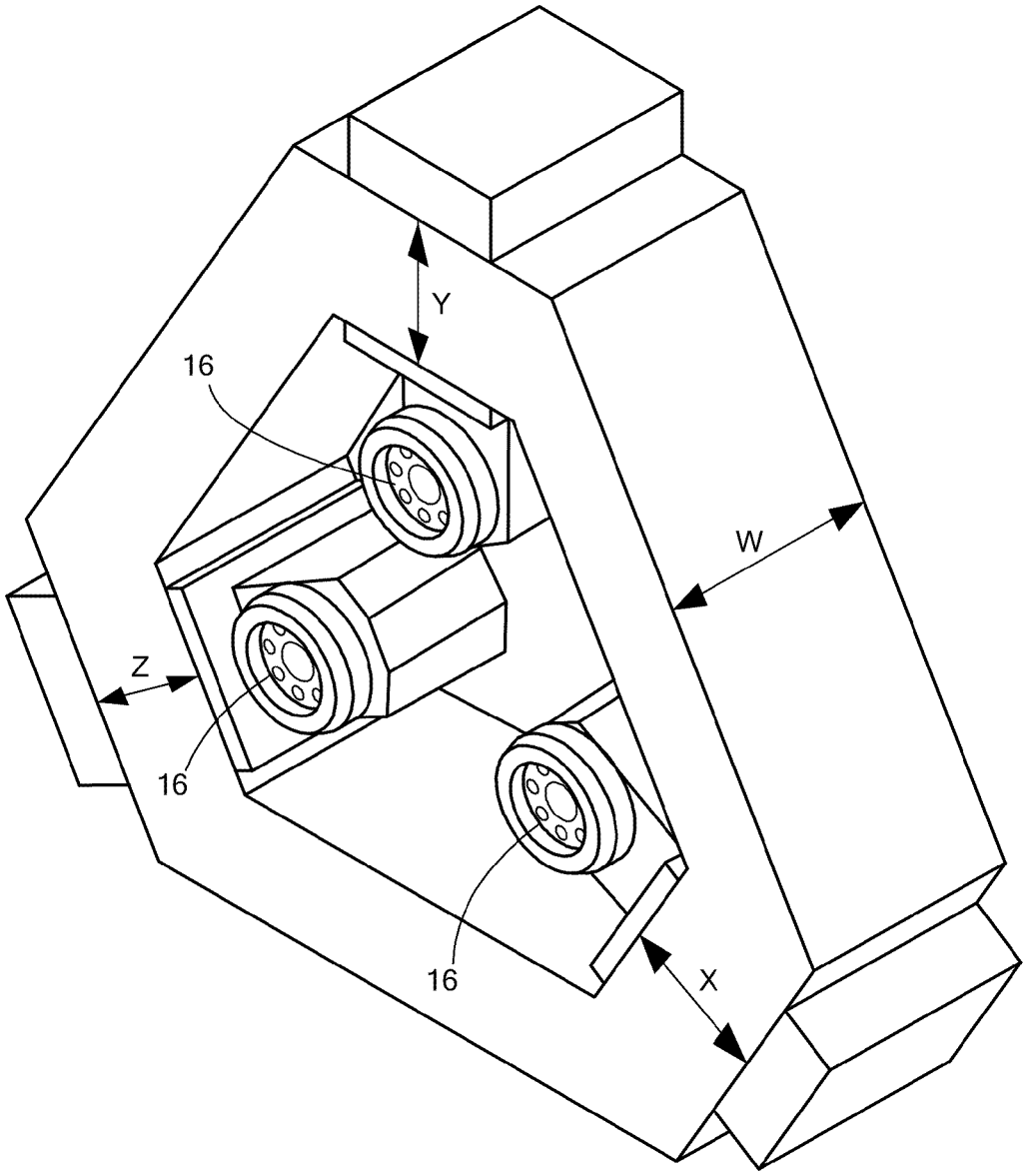
FIG. 7 schematically shows a perspective view of rollers according to embodiments of the present invention.
Figure 8:
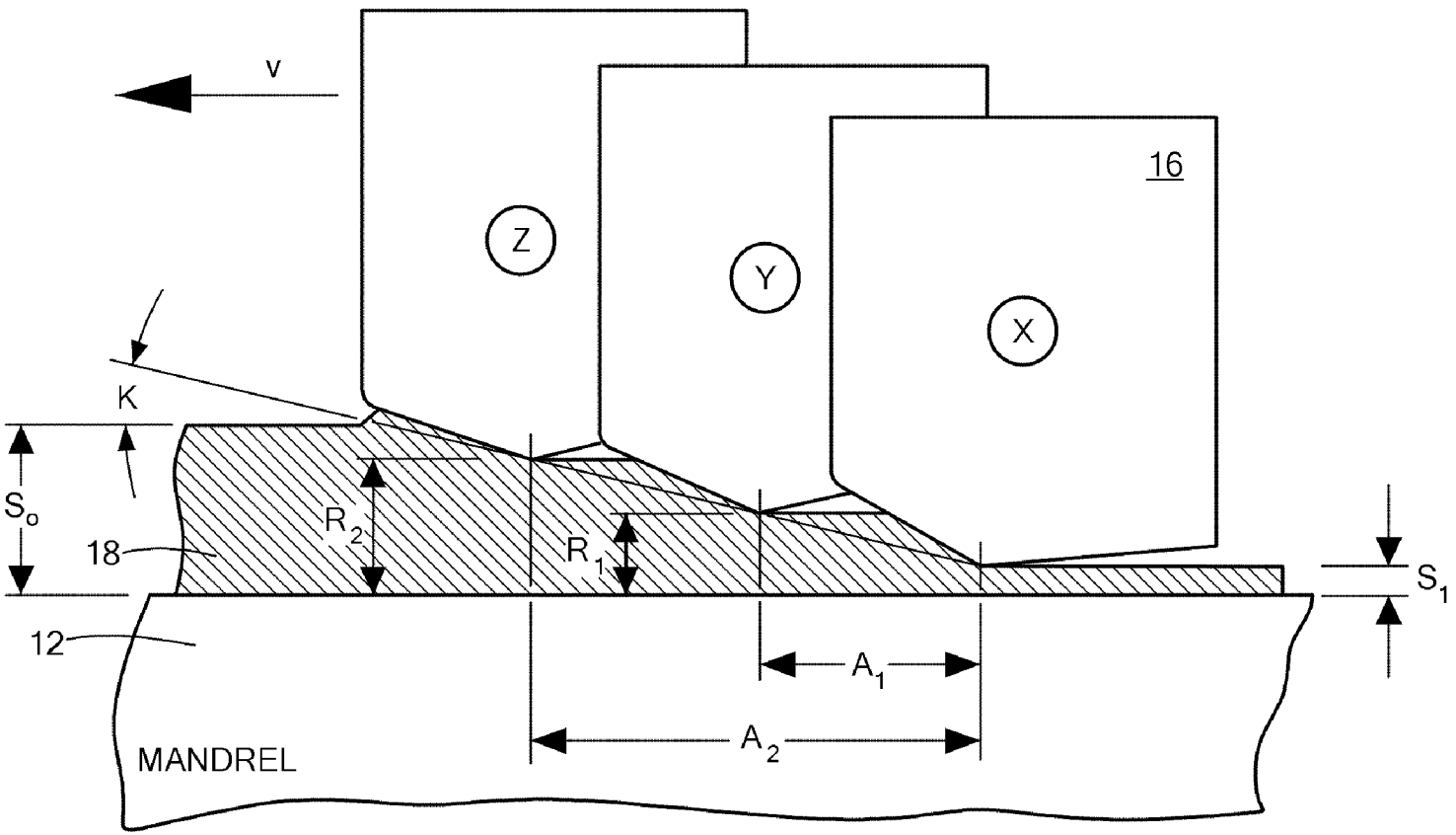
FIG. 8 schematically shows a side-view of a roller configuration with a workpiece undergoing a forward flowforming process according to embodiments of the present invention.

FIGS. 7 and 8 show a perspective view and side view, respectively, of a roller configuration according to embodiments of the present invention. FIG. 7 shows a carriage that houses three flowforming rollers (shown as X, Y and Z in FIG. 8) that may move along three axes (shown as X-, Y- and Z-axes) and which are radially located around the spindle axis, e.g., at 120° apart from one another. Although the figures show three rollers, the process may use two or more rollers. The independently programmable X, Y and Z rollers provide the necessary radial forces, while the right to left programmable feed motion of the W-axis applies the axial force. Each of the rollers may have a specific geometry to support its particular role in the forming process. In addition, the position of the rollers 16 may be staggered with respect to one another. The amount of stagger may be varied and may be based on the initial wall thickness of the workpiece and the amount of wall reduction desired in a given flowforming pass. For example, as shown in FIG. 8, $S_o$ shows the wall thickness of a workpiece before a given flowforming pass and $S_1$ shows its wall thickness after the flowforming process with the rollers 16 moving in the v direction. The rollers 16 may be staggered axially along an axial direction of the workpiece 18 (shown as the W-axis in FIG. 7) and may be staggered radially with respect to the centerline or inner diameter of the workpiece (along the X-, Y- and Z-axes), preferably to apply a relatively uniform compression to the outside of the workpiece 18. For example, as shown in FIG. 8, roller X may be separated from roller Y by a displacement or distance $A_1$ and may be separated from roller Z by a distance $A_2$ along an axial direction of the workpiece 18. Similarly, roller X may be radially displaced from the inner diameter of the workpiece a distance, $S_1$, which is the desired wall thickness of the workpiece 18 after a given flowforming pass, roller Y may be radially displaced a distance, $R_1$, and roller Z may be radially displaced a distance, $R_2$. As shown, an angle K may be used to help determine the amount of radial staggering once an axial staggering amount has been determined.

The more the rollers X, Y and Z are separated from one another the greater the helical twist imparted to the grain structure of the workpiece. A lubricant should be used between the inner diameter of the workpiece 18 and the mandrel 12 in order to reduce the problems of the workpiece 18 becoming stuck or jammed onto the mandrel 12 during this process. The compressive hoop stress imparted to the component in this way should reduce the probability of crack initiation and slow down the growth rate of any crack that may initiate on the inner diameter of the component, effectively improving the fatigue life of the tubular component. One benefit of this process is that the amount of compressive stress imparted to the inner diameter may be varied along the length of the tube depending on the roller configuration. For example, the rollers may be configured in such a way that a compressive stress is only imparted to one portion of the tube, e.g., on one end or in the middle of the tube.

Figure 9:
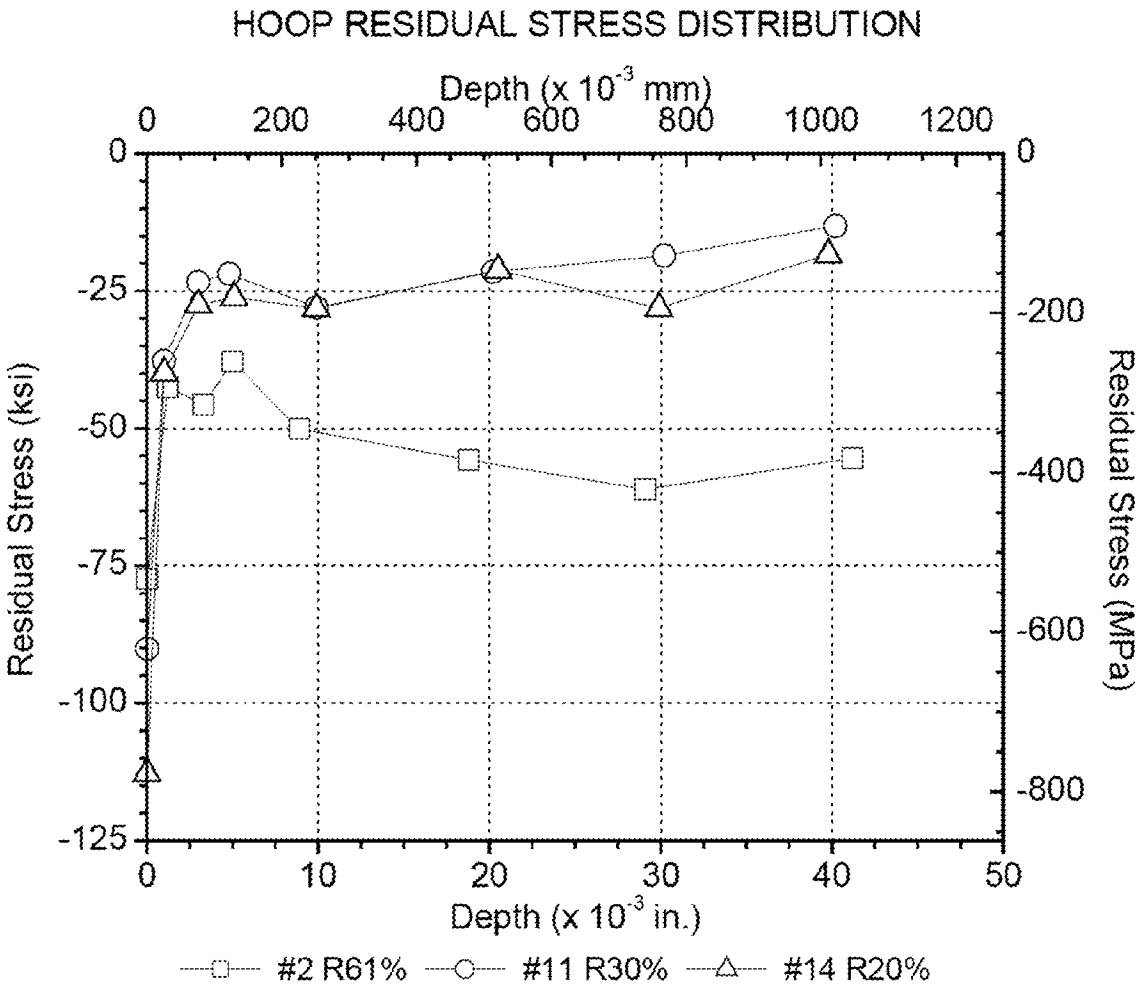
FIG. 9 shows a graph of residual hoop stress distribution for tubular components formed according to embodiments of the present invention.

FIG. 9 shows a graph of the residual hoop stress distribution for tubular components made of a cobalt superalloy material. As shown, three tubular workpieces of L-605 material were formed and each workpiece's wall thickness was reduced by approximately 61%, 30% and 20% total wall reduction, respectively, according to embodiments of the present invention. In this case, the three samples had final dimensions of about one inch for the inner diameter and about 0.100-0.150" for the wall thickness. As shown in FIG. 9, each workpiece exhibited a residual compressive stress at its inner surface with a smaller residual compressive stress still seen within the workpiece for the depth measured in the samples. The 20% wall reduction workpiece showed a higher residual hoop stress at the inner surface (e.g., 0 depth from the inner surface) than the 61% wall reduction workpiece, although the higher 61% wall reduction exhibited a larger compressive stress within the workpiece (e.g., about $5\text{-}40\times10^{-3}$ in. depth) than the 30% or 20% workpiece.

During the flowform process, the cross-sectional area of the workpiece's wall thickness is typically reduced by 20%, preferably by 30% or more, 50% or more, and may be reduced up to 75-85%. Although the outermost part of the workpiece may be plastically deformed with less than a 20% wall reduction per flowform pass, the material closest to the inner mandrel may not undergo enough plastic deformation so that sufficient texturing is accomplished in the workpiece along with a sufficient compressive stress on the inner surface of the workpiece. Therefore, large wall reductions are preferred. It is the large wall reduction penetrations during the flowforming process which plastically deforms the workpiece's wall sufficiently enough, homogenously "refines" the grains' size, and realigns the microstructure uniformly in the axial direction, parallel to the center line of the flowformed tube. In the case of hcp materials, such as cobalt-based superalloys, the crystal structures have radially oriented basal planes after flowforming. The axial directionality of the texture increases the biaxial strength of the material, effectively increasing the circumferential strength of the tubular component.

Flowforming typically improves the grain size and texture of a material. For example, tubing material was evaluated that was processed in two ways (1) cold-worked flowforming (75% wall reduction) and (2) non-cold-worked extruding (75% wall reduction). Titanium Commercially Pure Grade 2 (Ti CP2) was chosen as the constant material, as it is a common flowformed metal and is one of just a few alloys that has a hcp crystal structure, which is the same as cobalt. Both titanium and cobalt may experience a stress induced phase transformation from the flowform process. The grain structure samples were documented through preparation of metallographic cross sections in three orientations:

Longitudinal (parallel to the length of the tube)

Transverse (across the width of the tube)

Radial (flat-wise on the surface of the tube)

The microstructures were then documented by photographing the etched cross sections at 500× magnification. The microphotographs in each orientation were combined to create a simulated three-dimensional view of the grain structure in the three orientations. The microstructure (grain structure) of the flowformed material is shown in FIG. 10 and non-cold-worked material shown in FIG. 11.

Figure 10:
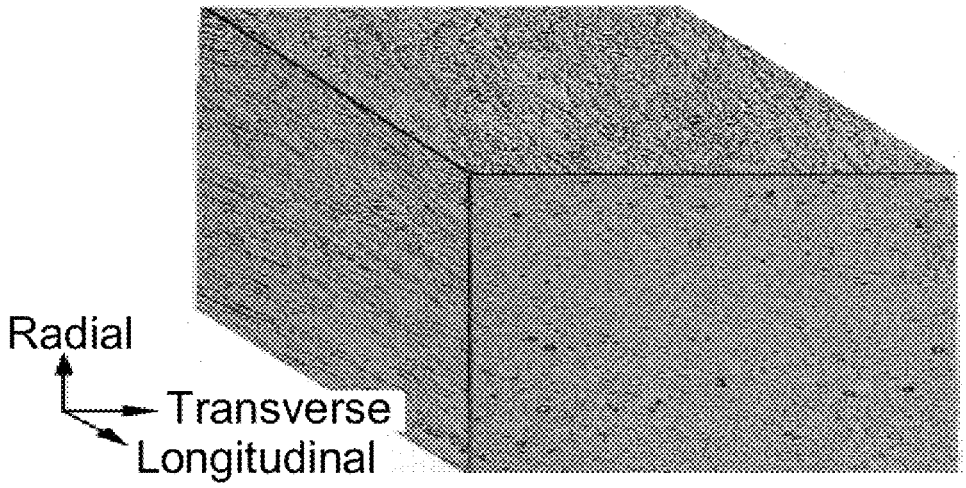
FIG. 10 shows a flowformed microstructure that may be formed according to embodiments of the present invention.
Figure 11:
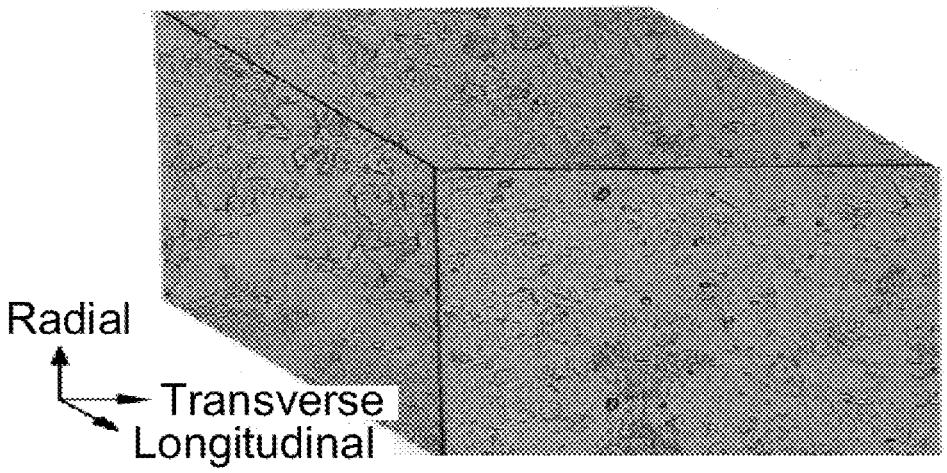
FIG. 11 shows a non-cold-worked microstructure.

As shown in FIGS. 10 and 11, the microstructure of the flowformed material is significantly altered compared to the non-cold-worked material. With flowforming at around a 75% wall reduction, the grains are elongated and flattened to create an "elongated pancake" shape. The grain size in the transverse orientation is very fine, with average grain size of 2.5 micron or ASTM no. 10-14 for this example. The microstructure of the non-cold-worked (hot extruded) material is equiaxed and is significantly larger than the flowformed material's, measuring an approximate average grain size of 9.5 micron or ASTM No. 9 for this example. The grain size of a cobalt superalloy (L-605) was also measured in the transverse orientation before and after a flowforming process. In this case, the sample was subjected to a 50% wall reduction and had a final dimension of about one inch for the inner diameter and about 0.100-0.150" for the wall thickness. The grain size in the preform measured about ASTM 5-6 whereas the grain size in the flowformed tube measure about ASTM 10-14, which was consistent with the grain size measured in the titanium sample mentioned above.

Figure 12:
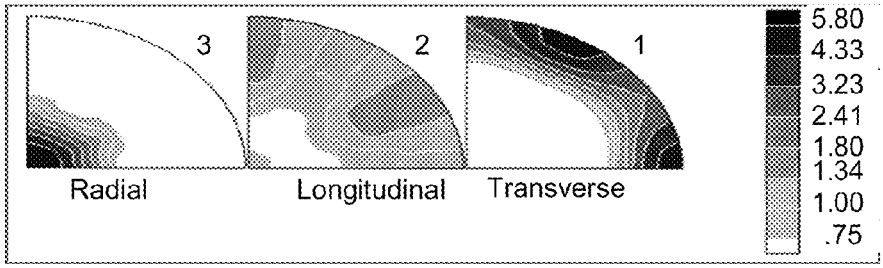
FIG. 12 shows an inverse pole figure for a flowformed material according to embodiments of the present invention.
Figure 13:
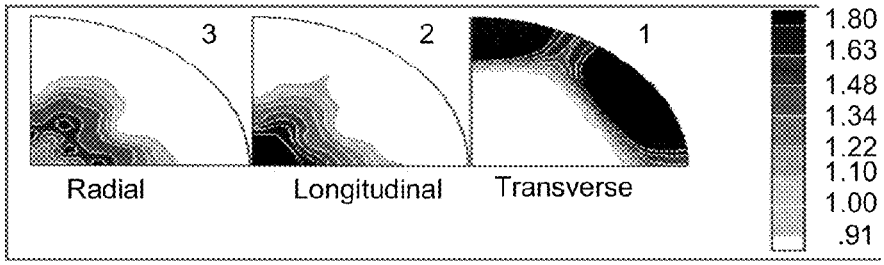
FIG. 13 shows an inverse pole figure for a non-cold-worked material.

The crystallographic texture of the two titanium hcp samples (each sample went through a 75% wall reduction, one cold worked with flowforming and the other hot worked) was determined using x-ray diffraction techniques. This involves conducting pole figure measurements in conjunction with Orientation Distribution Function (ODF) analysis to define the preferred crystallographic orientations of the cold-worked, flowformed sample versus the non-cold-worked sample. FIGS. 12 and 13 show the inverse pole figures of a cold-worked, flowformed material and a non-cold-worked material, respectively. As shown, the texture revealed by the inverse pole figures indicates basal <00.1> orientation evident in the normal, or radial, direction for the flowformed sample. The flowformed sample had <–1-1.0> and <–21.0> texture in the longitudinal direction. The non-cold-worked sample indicates a random or weak texture with some intensity shown in the longitudinal direction. The non-cold-worked sample exhibited primarily <0-1.0> and <–10.0> texture in the longitudinal direction. Note that the intensity of the sample shown in FIG. 12 is between 5 and 6 random, which is a highly textured "preferred orientation" presumably from the large wall reduction during flowforming and the stacking/alignment of the hcp crystals during forming/texturing. In FIG. 13, the non-cold-worked sample is between 1 and 2 random, which is a very weak or non-existent texture. This basically non-existent texture can be attributed to the fact that the material was "hot worked" above the material's transus temperature and there was not any texturing effect from cold work.

Figure 14:
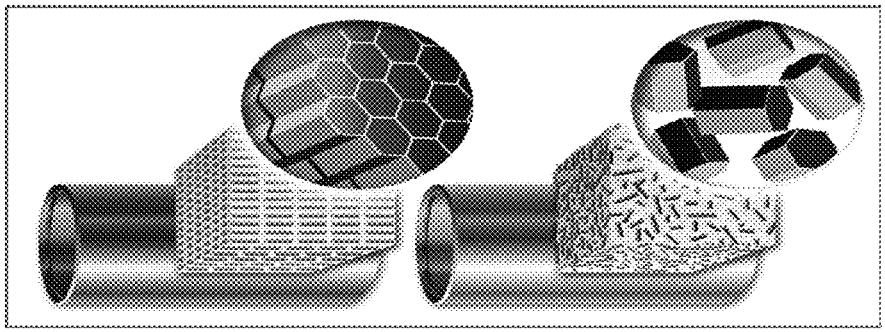
FIG. 14 schematically shows a flowformed hcp material microstructure versus a non-cold-worked hcp material microstructure.

The results of the crystallographic texture analysis revealed very significant differences between the two methods of processing the titanium. The overall texture of the flowformed material had radially oriented basal planes of the hcp crystal structure. The radial texture affords the material an increased biaxial strength, both in the longitudinal and transverse orientations. It has been proven that nearly all mechanical properties are influenced by texture. If the flowformed material is subsequently annealed, the grain structure recrystallizes and the texture intensifies. As shown in FIG. 14, the overall crystallographic texture of the non-cold-worked material is substantially more random or "misoriented" (shown on the right of the figure) than the flowformed texture (shown on the left of the figure).

The findings of this titanium hcp microstructure and crystallographic texture analysis are consistent with the findings of heavily cold-worked, thin wall (around 4 mm or smaller thickness) flowform zirconium (Zr), which is another hcp material. The Zr material has directional microstructure from the longitudinal flowform process and very strong radial (biaxial) crystallographic texturing of the basal planes of the hcp material, same as the flowformed titanium. Based on the texturing phenomenon learned from the heavily cold-worked, flowformed hcp material, flowformed cobalt alloys should also exhibit the same strong texturing effect as hcp Ti and Zr materials.

Figure 15:
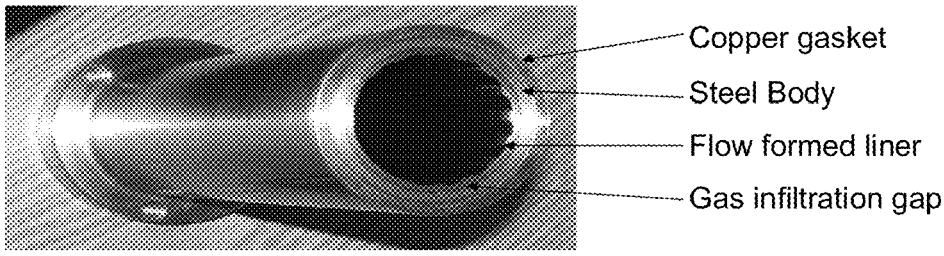
FIG. 15 shows a flowformed cobalt alloy gun barrel liner with rifling formed into the bore according to embodiments of the present invention.

In addition to flowforming parts over a smooth mandrel to create a smooth inner diameter of the flowformed tube, splines or rifling may be formed into the bore of a flowformed tube. This may be accomplished by having the outer surface of the mandrel 12 constructed in such a way as to impart rifling, grooves, notches, or other configurations to the inner surface of the workpiece as it is flowformed. For example, the mandrel may be constructed with spiral, straight, periodic, or other desired ridges on its surface. These ridges leave the rifling, grooves, notches and/or other configurations in the inner surface of the workpiece after the final flowforming pass is completed. FIG. 15 shows one flowformed tube formed with internal splines, which was successfully flowformed by Dynamic Flowform, Billerica, Mass., and made from four superalloy materials, 718 Inconel, Tantalum-Tungsten, and two cobalt-based alloys, MP159 and Aerex 350. Alternatively, rifling and/or other configurations may be imparted to the inner surface of the workpiece by, for example, appropriate machining of the inner surface of the workpiece after the flowforming process is completed.

Returning to the process of FIG. 3, the workpiece may be subjected to an optional heat treatment in step 120 after the wall reduction using the flowforming process. For example, the workpiece may be subjected to a precipitation hardening heat treatment one or more times. As known by those skilled in the art, there are two different heat treatments involving precipitates that can alter the strength of a material, solution heat treating and precipitation heat treating. Solid solution strengthening involves formation of a single-phase solid solution and leaves a material softer, whereas precipitation hardening is used to increase the material's yield strength. Precipitation hardening, also called age hardening or precipitation heat treatment, is a heat treatment process that relies on changes in solid solubility with temperature to produce fine particles of an impurity phase, which impede the movement of dislocations or defects in a crystal's lattice. Since dislocations are often the dominant carriers of plasticity, this process serves to harden the material. Once these particles are formed, then the precipitation hardening process allows the particles to grow at lower temperature. Alloys usually are maintained at elevated temperatures for extended periods of time, e.g., hours, to allow precipitation to take place. Precipitation hardening may produce many different sizes of particles, which may have different properties. Precipitation strengthening, like all heat treatments, is a fairly defined process. If the workpiece is subjected to the heat treatment for too little time (under aging), then the particles may be too small to impede dislocations effectively. If the workpiece is subjected to the heat treatment for too much time (over aging), then the particles become too large and dispersed to interact with the majority of dislocations, and the yield strength of the workpiece begins to decrease.

In embodiments of the present invention, a precipitation hardening process may use a variety of parameters depending upon the material used. For example, Inconel 718 is hardened by the precipitation of secondary phases (e.g. gamma prime and gamma double-prime) into the metal matrix. The precipitation of these nickel-(aluminum, titanium, niobium) phases is induced by heat treating in the temperature range of 1100 to 1500° F. Significantly, the workpiece may be subjected to the precipitation hardening heat treatment without having the workpiece first go through an annealing heat treatment. As known by those skilled in the art, annealing is a heat treatment wherein the material is heated to above its re-crystallization temperature for a suitable time, and then cooled, causing changes in its properties such as strength and hardness. Annealing is typically used to induce ductility, soften material, relieve internal stresses, and refine the structure by making it homogeneous so that the material may undergo further work such as forming and/or further processing, such as precipitation hardening.

As known by those skilled in the art, a material that has been hardened by cold working is typically softened by annealing to relieve the internal stresses imparted during the cold working process. In addition to relieving stresses, annealing may also allow grain growth or restore the original properties of the alloy depending on the temperature and duration of the annealing heat treatment used. When cold working superalloys, in particular, conventional wisdom dictates that the material undergo an annealing heat treatment after being cold worked. For example, many superalloys are used in aerospace applications that require high tensile strength, high fatigue strength, and good stress rupture properties. In Inconel 718, Haynes 25 and 188, for example, the material is typically solution heat treated prior to precipitation hardening to achieve these optimal properties. The high-temperature heat treatment is designed to recrystallize the grain structure and put age-hardenable constituents into solid solution to homogenize the cold worked material before applying an age-hardenable aging heat treatment. This is partly done to remove variations and defects in the material that may detrimentally impact these aging mechanical properties, but also done because of the difficulty in further forming the cold worked material. Annealing and then precipitation hardening (aging) maximizes the strength, fatigue and rupture properties. In embodiments of the present invention, however, an annealing process may not be used after the final flowforming pass imparts the compressive stress on the inner diameter of the workpiece, so that the compressive stresses remain. Instead, the precipitation hardening heat treatment strengthens the workpiece and increases the texturing effect without significantly relieving the compressive stresses imparted to the inner diameter during the flowforming process. Another benefit of embodiments of the present invention is that superalloy tubes should not loose this beneficial residual compressive stress when the component is subjected to higher temperatures during operation. For example, a gun barrel made out of conventional steel that has been autofrettaged, typically looses its residual compressive stresses at around 400° C., whereas a gun barrel made from a superalloy material and autofrettaged according to embodiments of the present invention should keep its internal compressive stress up to a much higher temperature, where fatigue failure issues more quickly become a concern.

Prior plastic deformation of solution treated cobalt alloys delays the beginning of the fcc to hcp isothermal martensitic transformation that takes place during aging at around 800° C. Residual internal stresses associated with strain-induced transformation are thermally relieved during the initial stages of aging via a mechanism involving stress-assisted transformation. This causes a rapid increase in the total amount of hcp phase present in the material. Additionally, other cold-working processes used to produce gun barrels and liners such as radial forge and rotary swage presumably may have the same radially oriented, crystallographic texturing effect on cobalt hcp alloys from the strain induced transformation. In order to have a strong texturing effect, the workpiece wall thickness may need to be reduced by around 20% or more.

Since cobalt has poor formability in the hcp phase, hot deformation is preferred in the fcc phase. For example, as shown in Table 3, the steady state stress of cobalt significantly decreases as working temperature increases. Thus, it is counterintuitive to be cold forming around room temperature using a flowforming process. As shown, the cobalt material becomes more ductile as the temperature increases and flowforming is cold working the material where it has a very high steady state stress.

TABLE 3

Steady state stress of cobalt at the indicated test conditions

| | $\sigma_s$ values in MPa at | | | | | |
|---|---|---|---|---|---|---|
| $\dot{\epsilon}$ ($s^{-1}$) | 600° C. | 700° C. | 750° C. | 800° C. | 900° C. | 950° C. |
| 0.001 | 185 | 115 | 87 | 73 | 52 | 41 |
| 0.01 | 244 | 152 | 119 | 99 | 64 | 50 |
| 0.1 | 325 | 212 | 167 | 145 | 90 | 74 |
| 1 | 410 | 274 | 218 | 179 | 122 | 104 |

The fcc to hcp transformation has been considered important to reducing the abrasive wear and improve the mechanical properties of cobalt-based alloys. Dry sliding wear of cobalt alloys against a hard metal counter-face can result from at least two mechanisms. Mild wear occurs at low loads or low sliding velocities leading to the formation of oxide debris. Under such an oxidative regime, the wear rate is essentially controlled by the kinetics of oxide formation as well as by the mechanical or thermomechanical properties of the oxide formed and its attachment to the surface. The microstructure is not of prime importance under these conditions. However, with higher loads or elevated sliding velocities, a transition to a severe metallic wear regime occurs, requiring the nucleation and propagation of cracks for the formation of wear debris. Products with much higher hardness are more wear resistant than the corresponding base alloys. In cast and powder metal alloys, HIPing the material does not change the phases present in the materials but greatly improves the microstructures by reducing the porosity and enhancing the interface bonding, which prevents the particles from spalling off the surface due to the mechanical attack in the wear process, increasing the wear resistance of the materials. Additionally, HIPed alloys have a much finer microstructure with fine carbides uniformly distributed in the matrix. The relative contact fatigue performance of the HIPed alloy is typically more than two orders of magnitude better than the cast alloy. This is attributed to the higher impact toughness and finer carbide morphology of the HIPed alloy, which resisted fatigue crack propagation. The main failure mode is spalling for the cast material and surface distress for the HIPed alloy. This supports the theory that a finer microstructure with high hardness improves wear resistance compared to larger grains, with lesser strength levels. The flowformed cobalt alloy with or without a subsequent heat treatment will have a very fine microstructure from the large wall deformation and increased radial or biaxial strength from the strong texturing.

The Group IVA elements (e.g., titanium, zirconium, and hafnium) adopt an hcp crystal structure at room temperature and zero pressure. When the temperature is raised, at zero pressure, these materials transform into a body-centered cubic (bcc) structure before the melting temperature is reached. However, when the pressure is increased, at room temperature, a crystallographic phase transition into the so-called omega structure occurs, which is hexagonal. These hcp alloys (e.g., titanium, zirconium and hafnium alloys) do not share the ability to undergo an fcc to hcp phase transformation, making this phenomenon unique to cold-worked cobalt alloys. The hcp texturing from the cold-worked, flowforming process in both the Group IVA elements and the cobalt materials should be very similar because both types of materials are compressed against the inner mandrel with extreme force during the large wall reductions, made to plastically deform through its cross section, inducing strain based phase transformation for the majority of the microstructure and made to crystallographically align its hcp crystal structure to a preferred, radial orientation.

The flowformed titanium material having an hcp alloy exhibits a fully dense, very fine grain size with radially oriented crystallographic texture, with its basal planes tightly packed and aligned normal (parallel) to each other, perpendicular to the inner diameter surface of the flowformed tube/barrel. The hexagonal basal planes make up a mosaic of flat surfaces, jigsaw puzzled together, increasing the surface's hardness, biaxial strength and wear resistance without compromising significant amounts of ductility (elongation). The strength can be further increased by performing a post-cold-work age-hardening heat treatment. Mechanical behavior of cold-worked cobalt alloys with about 50% hcp crystal mix have shown that the hardness and yield strength may be increased by at least 30% with aging without undue ductility losses. The wear resistance may be improved because the basal planes of the cobalt-based flowformed component are uniquely aligned parallel with one another, creating a smooth structure with less varied topography on the inner surface of the component.

For example, the surface roughness of two cobalt-based superalloy samples was determined using X-ray photoelectron spectroscopy and confocal microscopy techniques. One sample was cold worked with flowforming and went through a 50% wall reduction and the other sample was machined on the inner diameter and experienced no flowforming. The samples were ultrasonically cleaned in methanol to remove any surface debris prior to 2D and 3D imagining. The measurements were taken with 100× lens with a 0.9 numerical aperture. The measurements were then analyzed using nano focus software.

As known by those skilled in the art, a conventional (e.g., wide-field) fluorescence microscope floods the entire specimen evenly in light from a light source. All parts of the specimen in the optical path are excited at the same time and the resulting fluorescence is detected by the microscope's photodetector or camera including a large unfocused background part. In contrast, a confocal microscope uses point illumination and a pinhole in an optically conjugate plane in front of the detector to eliminate out-of-focus signal. Using confocal microscopy per ISO specification 25178, one can view 3D image and measure the height parameters of specimens' topography. The length of the x-axis and y-axis scan is the distance the instrument was setup to scan to capture all the height information observed with the sample under the lens. The height of the z-axis is determined by the variation in surface roughness observed. This includes any debris still located on the surface. The height of the grains is a function of the grain's texture orientation at the specimen's surface.

Figure 16:
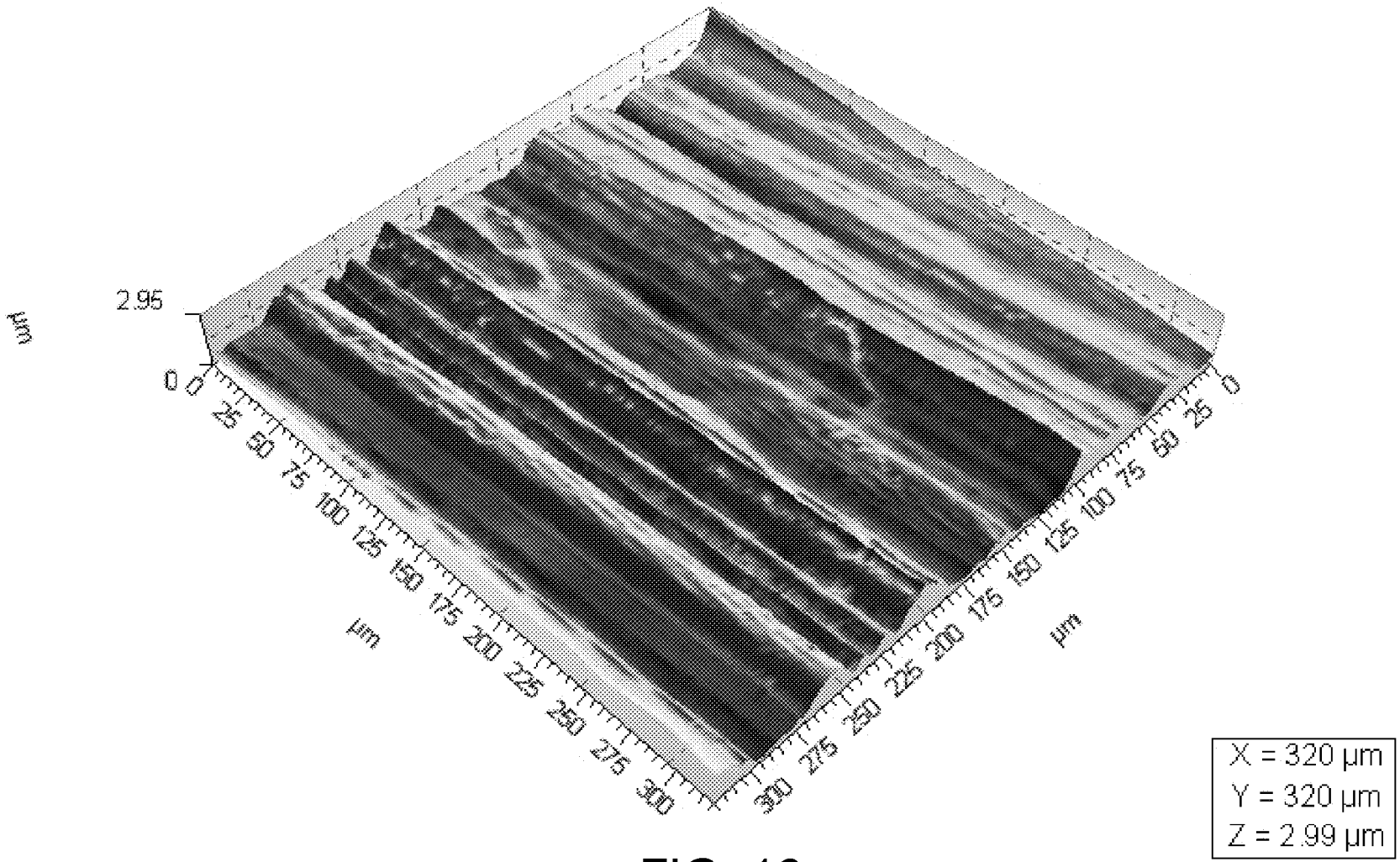
FIG. 16 shows the surface topography of an inner diameter of a machined cobalt alloy sample.
Figure 17:
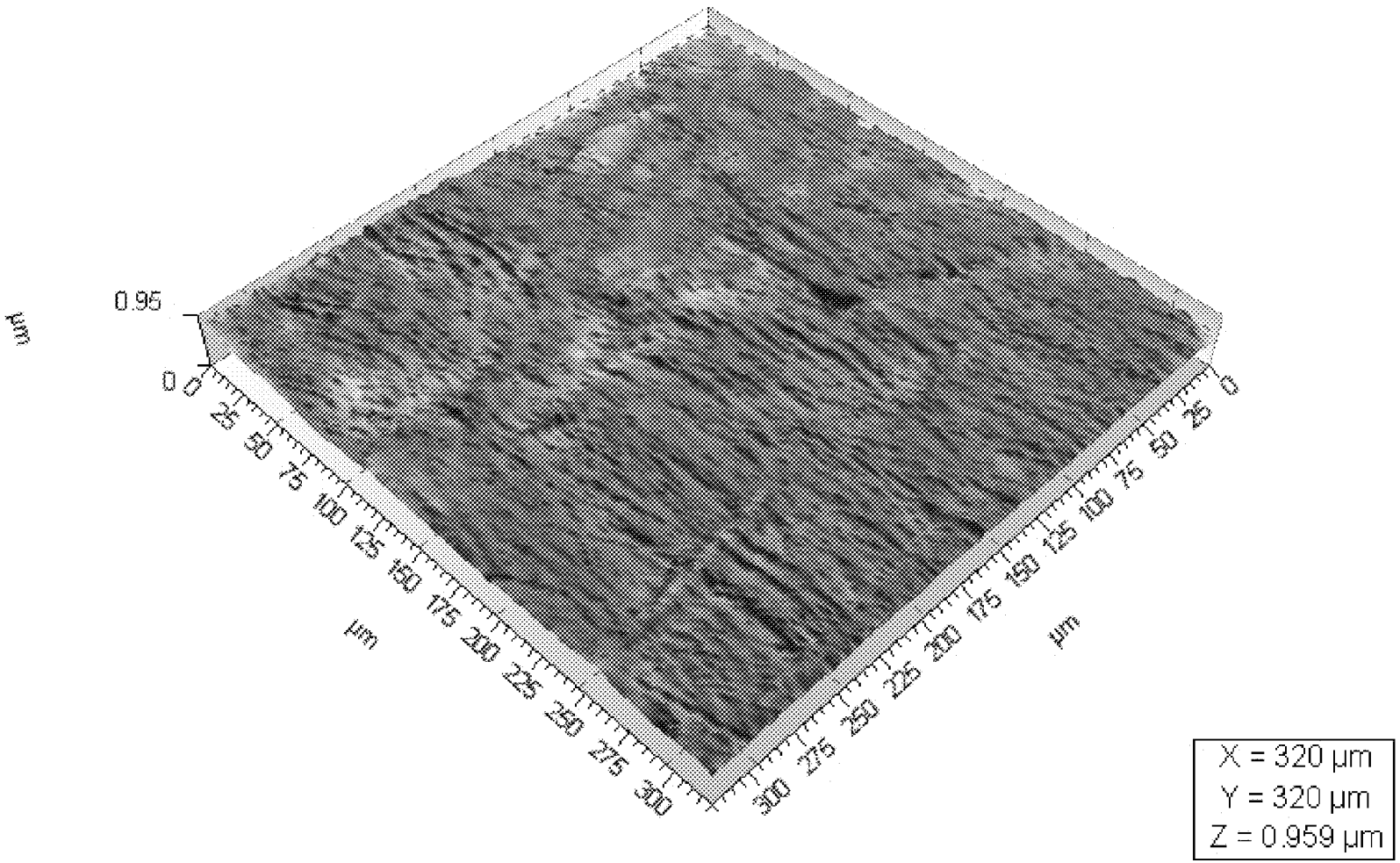
FIG. 17 shows the surface topography of an inner diameter of a flowformed cobalt alloy sample formed according to embodiments of the present invention.

As shown in FIGS. 16 and 17 and Tables 4 and 5 below, the surface roughness of the inner diameter of the flowformed cobalt-based alloy sample is significantly smoother than the machined sample. Thus, embodiments of the present invention provide a smoother inner surface of the component, which should improve the wear resistance of the component.

TABLE 4

| Surface roughness parameters for machined cobalt-based superalloy sample ISO 25178 | | | |
|---|---|---|---|
| Height Parameters | | | |
| Sa | 0.375 | μm | Arithmetic mean height |
| Sq | 0.449 | μm | Root mean square height |
| Ssk | 0.634 | | Skewness |
| Sku | 2.63 | | Kurtosis |
| Hybrid Parameters | | | |
| Sdr | 0.534 | % | Developed interfacial area ratio |

TABLE 5

| Surface roughness parameters for flowformed cobalt-based superalloy sample | | | |
|---|---|---|---|
| ISO 25178 | | | |
| Height Parameters | | | |
| Sa | 0.0337 | μm | Arithmetic mean height |
| Sq | 0.0443 | μm | Root mean square height |

TABLE 5-continued

| Surface roughness parameters for flowformed cobalt-based superalloy sample | | | |
|---|---|---|---|
| ISO 25178 | | | |
| Ssk | −0.419 | | Skewness |
| Sku | 7.16 | | Kurtosis |
| Hybrid Parameters | | | |
| Sdr | 0.0499 | % | Developed interfacial area ratio |

In Tables 4 and 5, the Developed Interfacial Area Ratio, Sdr, is the ratio of the increment of the interfacial area of a surface over the sampling area. This parameter is sensitive to the sampling interval. This parameter is often used to describe the "complexity" of the surface. It is the ratio of the area of the surface including the height data to the nominal area of the surface. A perfectly flat surface (no height deviations) would have a Sdr of 0%. S Height parameters are a class of surface finish parameters that quantify the Z-axis (per 3D: ISO 25178 Surface) perpendicular to the surface. The reference plane for the calculation of these parameters is the mean plane of the measured surface. As known by those skilled in the art, the Arithmetical Mean Height, Sa, is the mean surface roughness. Sa is useful for detecting variations in overall surface height and for monitoring an existing manufacturing process. The Root Mean Square Height, Sq, is the standard deviation of the height distribution, or RMS surface roughness. This parameter represents the standard deviation of the profile and is used in computations of skew and kurtosis. Sq cannot detect spacing differences or the presence of infrequent high peaks or deep valleys. The Skewness, Ssk, is the skewness of the height distribution which qualifies the symmetry of the height distribution. Surfaces that are smooth but are covered with particulates have positive skewness, while a surface with deep scratches/pits exhibit negative skewness. Ssk is very sensitive to outliers in the surface data. Kurtosis, Sku, is the kurtosis of the height distribution which qualifies the flatness of the height distribution. Sku is high when a high proportion of the surface falls within a narrow range of heights. If most of the surface is concentrated close to the mean surface level, Sku will be different than if the height distribution contains more bumps and scratches.

Large percentages of hcp mixture in the cobalt microstructure may be realized from strain induced fcc phase transformation of very large wall reductions (e.g., 20%-85%) during cold working tubular components over an inner rotating mandrel with extreme pressure from two or more rollers, such as in a flowforming process. The greater the wall reduction, the larger amount of stress induced phase transformation from the fcc to hcp phase is seen. For example, Table 6 shows the percentage of fcc versus hcp phase in the three cobalt superalloy tubes.

TABLE 6

| Quantitative phase analysis of cobalt superalloys by x-ray diffraction | | | |
|---|---|---|---|
| Sample | % Cubic | % Hexagonal | Percent Crystallinity |
| 20% Reduction End Face (Annealed) | 100.0 ± 1.5 | Not detected | 100.0 ± 1.5 (100% assumed) |
| 20% Reduction O.D. | 74.7 ± 1.1 | 25.3 ± 0.5 | 100.0 ± 1.2 (100% assumed) |
| 30% Reduction O.D. | 72.7 ± 1.2 | 27.3 ± 0.5 | 100.0 ± 1.3 (100% assumed) |
| 61% Reduction O.D. | 62.8 ± 3.7 | 37.2 ± 1.4 | 100.0 ± 3.9 (100% assumed) |

The strong, basal plane texturing phenomenon increases the surface area of the inner diameter of the tube with a more smooth topography compared to cast, powder metal with or without HIP, spray formed, laser deposited and hot-worked structures. The result is an increase in the strength and wear resistance of the material, making the cold-worked, cobalt liner or cobalt barrel last longer and be able to accommodate higher shot blasts for longer durations.

Figure 18:
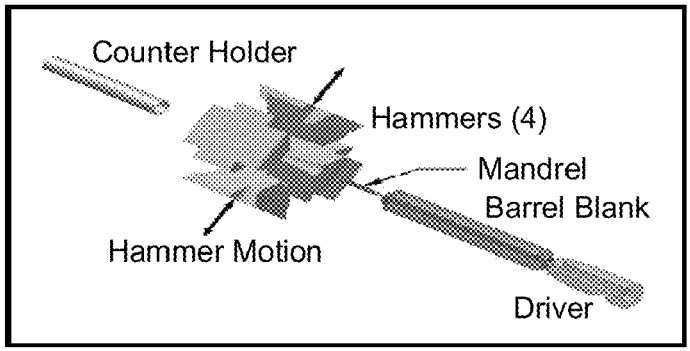
FIG. 18 shows a radial forge process that may be used according to embodiments of the present invention.
Figure 19:
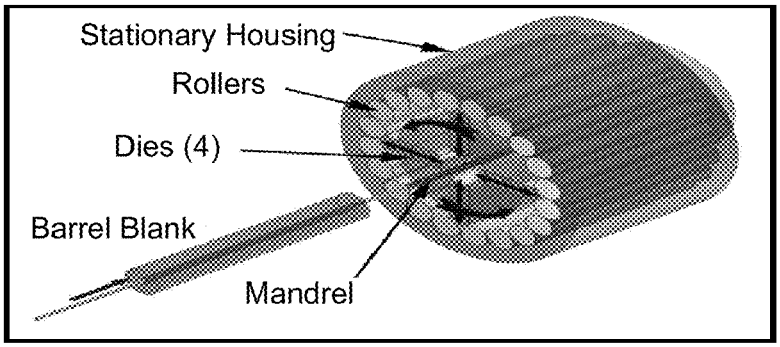
FIG. 19 shows a rotary swage process that may be used according to embodiments of the present invention.

Flowforming is a cold-working process that thermo-mechanically produces the preferred crystallographic texture to enhance biaxial strength and wear resistance of a gun barrel or its liner to prolong the barrel's utility. As mentioned above, however, the metal forming may include other cold working processes other than flowforming, such as radial forging, rotary swaging and/or pilgering. As known by those skilled in the art, a radial forge process may include four hammers moving in and out and hammering the workpiece over a mandrel, such as shown in FIG. 18. The driver and counter holder move the workpiece over the mandrel and into the reciprocating hammers. As known by those skilled in the art, a rotary swage process may include dies that rotate as a group inside of a stationary housing as the workpiece is pushed over the mandrel and into the dies which upsets/swages the material, such as shown in FIG. 19. As known by those skilled in the art, a pilgering process may include two rolls or dies, each with a tapering semi-circular groove running along the circumference, that engage a tubular component from above and below and rock back and forth over the tube (the pass length) while a stationary tapering mandrel is held in the center of the finished tube. At the beginning of a stroke or pass, the circular section formed between the grooves of the two opposing rolls corresponds to the diameter of the tube and to the thickest section of the mandrel. As the dies move forward over the tube, the circular section reduces in area until, at the end of the pass length, the circular section corresponds to the outer diameter of the finished tube and the inner mandrel diameter corresponds to the inner diameter of the finished tube, resulting in a longer length, smaller outer and inner diameter finished tube. In this manner, the tubular component is rotated and reduced by forging and elongating the tube stepwise over the stationary tapered mandrel reducing the tube.

It is anticipated that using these metal forming processes on a cobalt superalloy, as discussed above with respect to the flowforming process, may provide similar increased radial or biaxial strength along with a strong crystallographic texture in the tubular component. In addition, it is anticipated that staggering the rollers, dies, and/or hammers used in these metal forming processes, such as discussed above with respect to the flowforming process, may provide similar beneficial compressive stress results on the inner diameter of the workpiece.

Although the above discussion discloses various exemplary embodiments of the invention, it should be apparent that those skilled in the art can make various modifications that will achieve some of the advantages of the invention without departing from the true scope of the invention.

What is claimed is:

1. A method of producing a gun barrel, the method comprising:

forming a cobalt or cobalt alloy tubular workpiece having at least about 30% by weight of fcc phase; and subjecting the workpiece to at least about a 20% wall reduction, in one reduction operation, at a temperature below a recrystallization temperature of the workpiece using a metal forming process, the metal forming process comprising radial forging, rotary swaging, pilgering, flowforming, or a combination thereof.

2. The method of claim 1, wherein the temperature is around room temperature.

3. The method of claim 1, further comprising annealing the workpiece after subjecting the workpiece to the wall reduction.

4. The method of claim 1, further comprising forming a rifling on an inner diameter of the workpiece.

5. The method of claim 1, wherein the metal forming process is flowforming, and the flowforming includes at least two flowforming passes.

6. The method of claim 5, further comprising annealing the workpiece between the flowforming passes.

7. The method of claim 1, wherein the workpiece includes at least 50% by weight fcc phase.

8. The method of claim 1, wherein the workpiece includes at least 80% by weight fcc phase.

9. The method of claim 1, wherein the wall reduction is at least about 30%.

10. The method of claim 1, wherein the wall reduction is at least about 50%.

11. The method of claim 1, wherein the tubular workpiece is produced by rotary forging or rotary swaging.

12. A gun barrel produced according to the method of claim 1.

13. The method of claim 1, wherein subjecting the workpiece to at least about a 20% wall reduction causes at least a portion of the fcc phase to transform to an hcp crystal structure, increasing, by at least two times, an amount of basal planes radially oriented perpendicular to an inner diameter of the workpiece.

14. The method of claim 13, wherein the workpiece has at least about 25% by weight of hcp phase with the basal planes radially oriented perpendicular to the inner diameter of the workpiece after the wall reduction.

15. A method of producing a cobalt-based superalloy tubular component, the method comprising:

forming a tubular workpiece made of a cobalt-based superalloy material having at least about 30% by weight of fcc phase, the tubular workpiece having an inner diameter and an outer diameter;

placing the workpiece on a mandrel such that the inner diameter is adjacent to the mandrel;

subjecting the workpiece to at least about a 20% wall reduction, in one reduction operation, at a temperature below a recrystallization temperature of the workpiece using a metal forming process that compresses the outer diameter of the workpiece using a combination of axial and radial forces so that the mandrel contacts the inner diameter.

16. The method of claim 15, wherein the metal forming process includes radial forging, rotary swaging, pilgering, flowforming, or a combination thereof.

17. The method of claim 15, wherein the temperature is around room temperature.

18. The method of claim 15, further comprising annealing the workpiece after subjecting the workpiece to the wall reduction.

19. The method of claim 15, wherein the mandrel further imparts a rifling to the inner diameter of the workpiece.

20. The method of claim 15, wherein the metal forming process is flowforming, and the flowforming includes at least two flowforming passes.

21. The method of claim 15, wherein the tubular workpiece is produced by rotary forging or rotary swaging.

22. A tubular component produced according to the method of claim 15.

23. The method of claim 15, wherein subjecting the workpiece to at least about a 20% wall reduction causes at least a portion of the fcc phase to transform to an hcp crystal structure, increasing, by at least two times, an amount of basal planes radially oriented perpendicular to the inner diameter of the workpiece.

24. The method of claim 23, wherein the workpiece has at least about 25% by weight of hcp phase with the basal planes radially oriented perpendicular to the inner diameter of the workpiece after the wall reduction.

* * * * *